US009487030B2

(12) United States Patent
Wakabayashi et al.

(10) Patent No.: US 9,487,030 B2
(45) Date of Patent: Nov. 8, 2016

(54) MEDIUM HOLDING MEMBER AND RECORDING APPARATUS

(71) Applicant: SEIKO EPSON CORPORATION, Tokyo (JP)

(72) Inventors: Teruhiko Wakabayashi, Matsumoto (JP); Atsushi Majima, Matsumoto (JP); Eiji Kumai, Matsumoto (JP); Osamu Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/871,430

(22) Filed: Sep. 30, 2015

(65) Prior Publication Data

US 2016/0089905 A1 Mar. 31, 2016

(30) Foreign Application Priority Data

Sep. 30, 2014 (JP) ..... 2014-200017

(51) Int. Cl.
*B41J 11/00* (2006.01)
*B65H 23/24* (2006.01)

(52) U.S. Cl.
CPC ..... *B41J 11/0045* (2013.01); *B65H 23/24* (2013.01); *B65H 2301/5111* (2013.01); *B65H 2404/511* (2013.01); *B65H 2406/352* (2013.01); *B65H 2406/3511* (2013.01); *B65H 2406/3662* (2013.01); *B65H 2801/36* (2013.01)

(58) Field of Classification Search
CPC ... B41J 11/0005; B41J 11/005; B41J 11/006; B41J 25/3084; B41J 25/312; B41J 11/0045; B41J 11/06; B41J 11/02; B41J 11/0085; B65H 16/02
See application file for complete search history.

(56) References Cited

U.S. PATENT DOCUMENTS 5,454,648 A * 10/1995 Lee ..... B41J 13/10 271/240
2006/0268087 A1 11/2006 Sasa
2009/0079795 A1* 3/2009 Motoharu ..... B41J 11/06 347/56
2011/0050826 A1* 3/2011 Katagami ..... B41J 11/005 347/104
2014/0132691 A1 5/2014 Ishikawa et al.

FOREIGN PATENT DOCUMENTS

JP 2004-230839 8/2004
JP 2007/118480 5/2007
JP 2014-094540 5/2014

* cited by examiner

*Primary Examiner* — Henok Legesse
(74) *Attorney, Agent, or Firm* — Workman Nydegger

(57) ABSTRACT

A medium holding member that is attached to a medium supporting portion includes a fitting portion that is fit into the medium supporting portion and that is located at each of at least one portion in an upstream side edge portion of the medium holding member in a medium transportation direction.

14 Claims, 16 Drawing Sheets

MEDIUM HOLDING MEMBER AND RECORDING APPARATUS

BACKGROUND

1. Technical Field

The present invention relates to a medium holding member and a recording apparatus including the medium holding member.

2. Related Art

Heretofore, there has been well known an ink jet printer that performs printing by ejecting inks onto a medium, such as paper, having been transported onto a medium supporting portion. For example, in JP-A-2014-94540, there is proposed a liquid ejecting apparatus (recording apparatus) that makes it possible to form ribs on a medium supporting portion easily.

In such a recording apparatus proposed in JP-A-2014-94540, the medium supporting portion includes concave portions each including absorbing holes, as well as supporting members disposed in the respective concave portions, and these supporting members make it possible to form the ribs on the medium supporting portion easily. Paper having been unwound from a cylindrically-shaped rolled object is transported by transportation rollers onto the medium supporting portion, where the paper is absorbed and stuck fast to the medium supporting portion. Further, ink droplets having been ejected from a liquid ejecting portion are landed on the paper and thereby given images are printed on the paper. In this case, for example, when the paper lifts from the medium supporting portion because of a curling tendency of the paper, the gap distance between the paper and the liquid ejecting portion becomes unequal, thereby causing the possibility of degradation of a printing quality. For this reason, a pair of medium holding members is attached to the medium supporting portion, and this pair of medium holding members suppresses the lift of the paper from the medium supporting portion. Specifically, each of the pair of medium holding members includes a latching nail in the vicinity of a central portion thereof as well as another latching nail at the downstream side thereof in a paper transportation direction, and the relevant medium holding member is fixed to the medium supporting portion by the latching nails. Each of the both edges of the paper passes through the gap between a corresponding one of the pair of medium holding members and the medium supporting portion, and the lift of the paper is suppressed by the pair of medium holding members and the medium supporting portion.

When a curling tendency of paper having been transported by the transportation rollers causes the paper to lift from the medium supporting portion, the paper interferes with (comes into contact with) an upstream side portion of each of the medium holding members in the paper transportation direction, and thereby an external force is applied to the relevant medium holding member from the paper. This external force applied to the relevant medium holding member becomes a force that acts in a direction in which the force causes the relevant medium holding member to lift from the medium supporting portion.

In this case, since any latching nail is not formed in the upstream side portion of each of the pair of medium holding members in the paper transportation direction, when the external force is repeatedly applied to the relevant medium holding member, the upstream side portion of the relevant medium holding medium in the paper transportation direction lifts from the medium supporting portion and, as a result, the relevant medium holding member and the liquid ejecting portion interfere with each other (come into contact with each other), thereby causing the possibility that a defect (failure) occurs in the liquid ejecting portion.

Further, any variation of the position of each of the pair of medium holding members due to the external force makes it hard for a corresponding one of the both edges of the paper to pass through the gap between the medium supporting portion and the relevant medium holding medium. Moreover, the variation of the position of the relevant medium holding member also makes it hard for the relevant medium holding member and the medium supporting portion to suppress the lift of the paper and, as a result, the gap distance between the paper and the liquid ejecting portion becomes unequal, thereby causing the possibility of degradation of a printing quality.

SUMMARY

The invention can be realized in the following application examples, and exemplary embodiments described below.

Application Example 1

A medium holding member according to this application example is attached to a medium supporting portion and includes a fitting portion that is fit into the medium supporting portion and that is located at each of at least one portion in an upstream side edge portion of the medium holding member in a medium transportation direction.

The medium holding member according to this application example includes the fitting portion that is fit into the medium supporting portion, and through this fitting portion, it is possible to fix the upstream side edge portion of the medium holding member in the medium transportation direction to the medium supporting portion. Thus, the upstream side edge portion of the medium holding member in the medium transportation direction can be placed in a state of being hard to lift even though an external force is applied thereto.

Application Example 2

In the medium holding member according to the above application example, preferably, the fitting portion includes a portion that inclines from an upstream side in the medium transportation direction toward a downstream side in the medium transportation direction.

When the fitting portion includes the portion that inclines from the upstream side in the medium transportation direction toward the downstream side in the medium transportation direction, that is, a portion that inclines in a direction intersecting with a direction perpendicular to the medium transportation direction, it is possible to mitigate the influence of a force acting in the direction perpendicular to the medium transportation direction. That is, when a force acting in the direction perpendicular to the medium transportation direction is applied to the upstream side edge portion of the medium holding member in the medium transportation direction, the portion that is included in the fitting portion and that inclines in the direction intersecting with the direction perpendicular to the medium transportation direction makes it possible to suppress the medium holding member from lifting in the direction perpendicular to the medium transportation direction.

Application Example 3

In the medium holding member according to the above application example, preferably, the fitting portion includes a portion extending in the medium transportation direction.

When the fitting portion includes the portion extending in the medium transportation direction, it is possible to mitigate the influence of a force acting in a direction perpendicular to the medium transportation direction. That is, when the force acting in the direction perpendicular to the medium transportation direction is applied to the upstream side edge portion of the medium holding member in the medium transportation direction, the portion that is included in the fitting portion and that extends in the medium transportation direction makes it possible to suppress the medium holding member from lifting in the direction perpendicular to the medium transportation direction.

Application Example 4

The medium holding member according to the above application example preferably further includes an engaging portion that is engaged with the medium supporting portion and that is located at each of at least one portion in a downstream side edge portion of the medium holding member in the medium transportation direction.

The medium holding member according to this application example includes the engaging portion in a downstream side edge portion of the medium holding member in the medium transportation direction, and thus, it is possible to fix the downstream side edge portion of the medium holding member in the medium transportation direction, in addition to the above upstream side edge portion of the medium holding member in the medium transportation direction, to the medium supporting portion. Thus, it is possible to more firmly fix the medium holding member to the medium supporting portion, as compared with the case where only the upstream side edge portion of the medium holding member in the medium transportation direction is fixed to the medium supporting portion.

Application Example 5

The medium holding member according to the above application example preferably further includes a latching portion that is latched together with the medium supporting portion and that is located at a more downstream side than the fitting portion in the medium transportation direction.

The medium holding member according to this application example includes such a latching portion at a more downstream side than the fitting portion in the medium transportation direction, and thus, it is possible to fix, in addition to the above upstream side of the medium holding member in the medium transportation direction, the downstream side of the medium holding member in the medium transportation direction to the medium supporting portion. Thus, it is possible to more firmly fix the medium holding member to the medium supporting portion, as compared with the case where only the upstream side edge portion of the medium holding member in the medium transportation direction is fixed to the medium supporting portion.

Application Example 6

The medium holding member according to the above application example is preferably configured such that the medium holding member is fixed to the medium supporting portion at each of at least three portions whose positions are different from one another.

When the medium holding member is fixed to the medium supporting portion at each of at least three portions whose positions are different from one another, it is possible to more firmly fix the medium holding member to the medium supporting portion, as compared with the case where only the upstream side edge portion of the medium holding member in the medium transportation direction is fixed to the medium supporting portion, and the case where the two portions of the medium holding member are fixed to the medium supporting portion.

Application Example 7

The medium holding member according to the above application example preferably further includes a medium receiving portion that receives the medium and is disposed between the medium holding member and the medium supporting portion, and that is located at each of at least one portion in the upstream side edge portion of the medium holding member in the medium transportation direction.

The medium holding member according to this application example includes the medium receiving portion that receives the medium and is disposed between the medium holding member and the medium supporting portion, and that is located at each of at least one portion in the upstream side edge portion of the medium holding member in the transportation direction. Since the upstream side edge portion of the medium holding member in the medium transportation direction is fixed to the medium supporting portion, the position the medium receiving portion is hard to vary, thus enabling the medium receiving portion to stably receive medium.

Application Example 8

A recording apparatus according to this application example includes a transportation portion that transports a medium in a transportation direction; a recording portion that performs recording onto the medium; and a medium supporting portion that supports the medium; and a medium holding member that holds the medium, and the medium supporting portion includes a fitted portion into which a fitting portion of the medium holding member is fitted.

In the recording apparatus according to this application example, the medium holding member is fixed to the fitted portion of the medium supporting portion, and thus, even when a force that causes the medium holding member to lift from the medium supporting portion is applied to the medium holding member from a medium having been transported from the transportation portion, it is possible to suppress the lift of the medium holding member from the medium supporting portion. Accordingly, it is possible to suppress the possibility that the lift of the medium holding member from the medium supporting portion causes the medium holding member and the medium supporting portion to interfere with each other (come into contact with each other) and, as a result, a defect (failure) occurs in the recording portion.

Application Example 9

In the recording apparatus according to the above application example, preferably, the medium supporting portion includes a concave portion that is latched together with a latching portion of the medium holding member and that is located at a more downstream side position than a position of the fitted portion in the transportation direction.

In the recording apparatus according to this modification example, the medium holding member is fixed to both of the fitted portion and the concave portion that are disposed in the medium supporting portion, and thus, it is possible to more firmly fix the medium holding member to the medium supporting portion, as compared with the case where the medium holding member is fixed to only the fitted portion of the medium supporting portion. Thus, even when a force that causes the medium holding member to lift from the medium supporting portion is applied to the medium holding member from a medium having been transported from the transportation portion, it is possible to more strongly suppress the lift of medium holding member from the medium supporting portion. Accordingly, it is possible to more strongly suppress the possibility that the lift of the medium holding member from the medium supporting portion causes the medium holding member and the medium supporting portion to interfere with each other (come into contact with each other) and, as a result, a defect (failure) occurs in the recording portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments according to the invention will be described with reference to the drawings. These embodiments described below are just embodiments in accordance with some aspects of the invention, and do not limit the invention. Further, these embodiments described below may be modified as needed within the scope of the technical thought of the invention. Further, in each of drawings referred to below, in order to make the size of each of layers and portions illustrated on each of the drawings a recognizable degree of size, the scale of each of the layers and portions is made different from an actual scale.

Embodiment 1

Outline of Recording Apparatus

Figure 1:
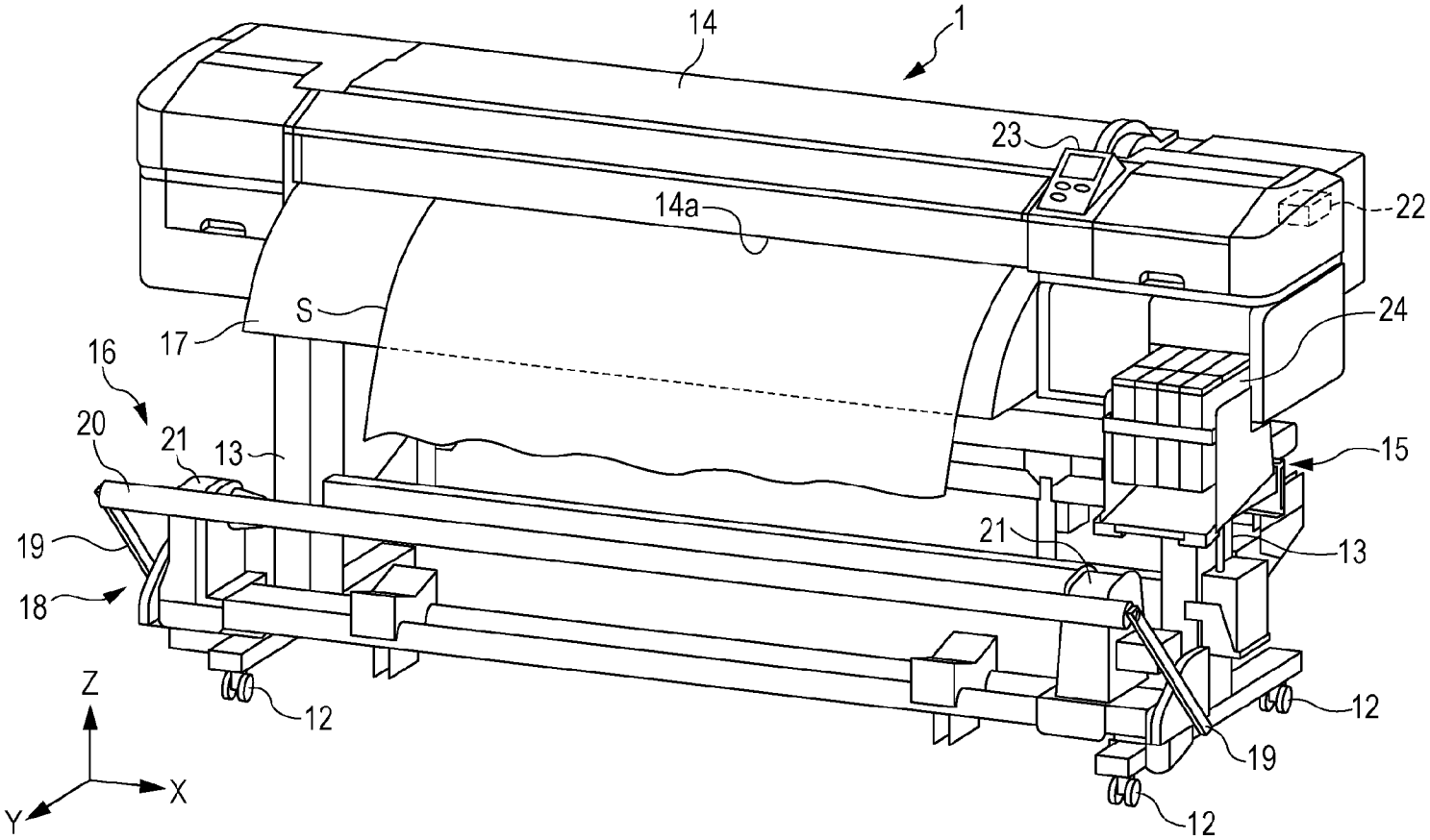
FIG. 1 is a perspective view of a recording apparatus according to embodiment 1 of the invention.
Figure 2:
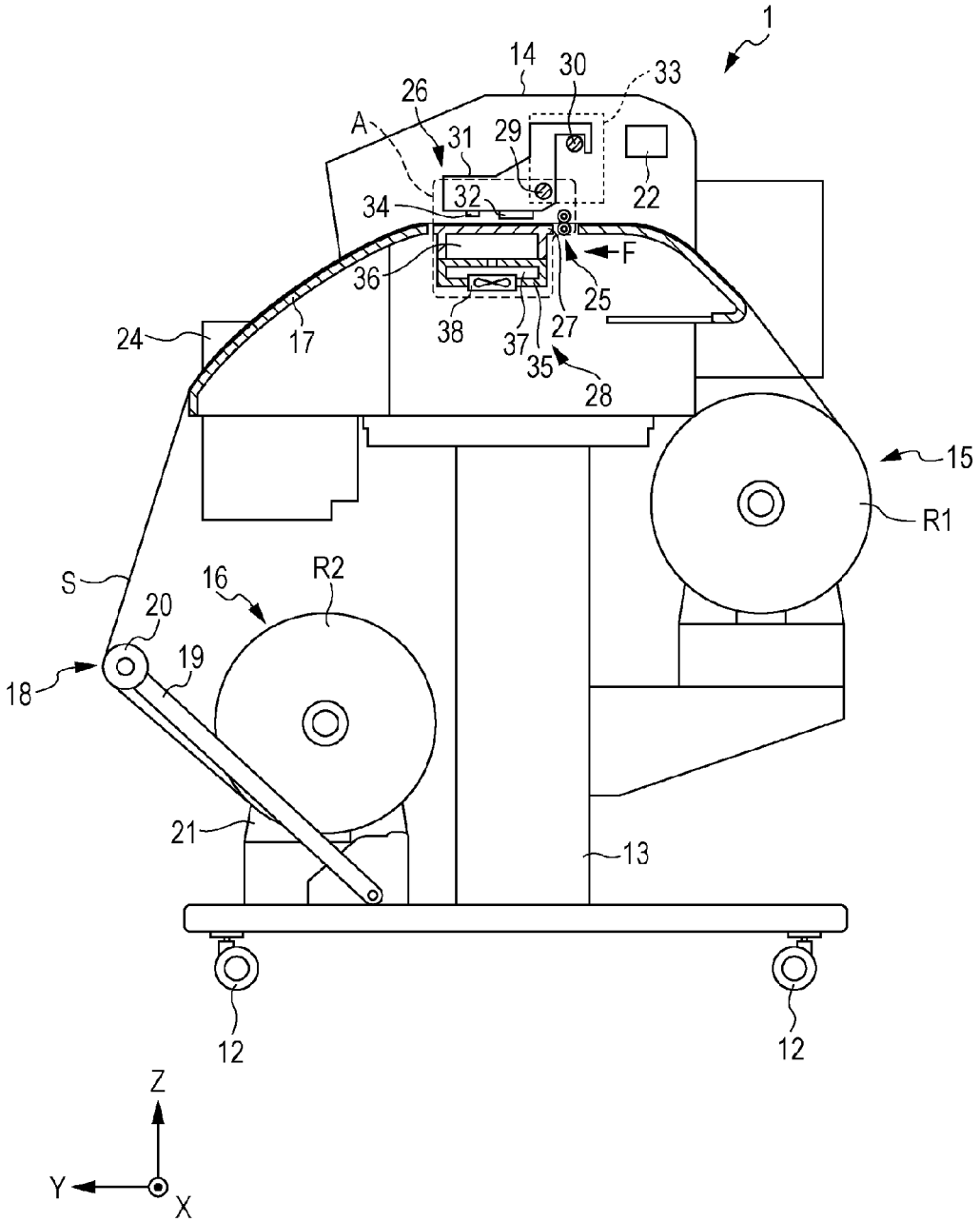
FIG. 2 is a schematic diagram illustrating an outline configuration of a recording apparatus according to embodiment 1 of the invention.

FIG. 1 is a perspective view of a recording apparatus according to this embodiment. FIG. 2 is a schematic diagram illustrating an outline configuration of the recording apparatus according to this embodiment.

First, the outline of a recording apparatus 1 will be described with reference to FIGS. 1 and 2.

As shown in FIG. 1, the recording apparatus 1 according to this embodiment is a large format printer (LFP) that handles long-size paper S. The recording apparatus 1 includes a pair of leg portions 13 each including wheels 12 attached to the bottom edge thereof, and a housing portion 14 mounted on the pair of leg portions 13.

In addition, the paper S is an example of "a medium" in the appended claims of the invention, and is made of, for example, a fabric such as a polyester material, paper, or a film.

In a lower rear portion of the housing portion 14, a feeding portion 15 for feeding the paper S toward a side of the housing portion 14 is disposed. The paper S is rolled paper and is also a transfer medium (transfer paper) for use in sublimation transfer printing that is performed by transferring a transfer image (mirror image) to a transferred medium, the transfer image (mirror image) being formed so as to leave a blank space in each of both edge portions of the transfer medium in a long-side direction of the housing portion 14. Further, the recording apparatus 1 is an ink jet printer that forms a transfer image by ejecting sublimation printing inks, each of which is an example of a liquid, onto the paper S.

In addition, the feeding portion 15 is an example of "a transportation portion" in the appended claims of the invention.

In a lower front portion of the housing portion 14, a winding portion 16 supported by the pair of leg portions 13 is disposed. In a portion between the feeding portion 15 and the winding portion 16, a medium guiding portion 17 is disposed along a transportation route of the paper S.

The rear edge side of the medium guiding portion 17 is contained in the housing portion 14 and the front edge side of the medium guiding portion 17 protrudes frontward from the housing portion 14. Further, in a front side portion of the housing portion 14, an ejection outlet 14*a* for ejecting the paper S from the inside of the housing portion 14 is formed at a position above the medium guiding portion 17.

In a portion located near the winding portion 16, a tension applying mechanism 18 for applying a tension (a tensile force) to the paper S that is located between the medium guiding portion 17 and the winding portion 16 is provided. The tension applying mechanism 18 includes a pair of arm members 16 that are each supported at a bottom portion of a corresponding one of the pair of leg portions 13 so as to be pivotable, and a tension roller 20 that is supported at the edge portions of the pair of arm members 19 so as to be rotatable. Further, the winding portion 16 includes a pair of holders 21 for pinching a central core member (not illustrated), such as a paper tube, around which printed paper S is wound in a cylindrical state, from both central-axis direction sides of the central core member.

In a portion inside the housing portion 14, a control portion 22 for controlling the operation of the recording apparatus 1 is provided. Further, in an upper portion of the housing portion 14, an operation panel 23 for use in setting operations and input operations is provided at a first edge side (a right-hand side in FIG. 1) in the long-side direction of the housing portion 14. In addition, the operation panel 23 is electrically connected to the control portion 22.

In a lower portion of the housing portion 14, a plurality of liquid containing vessels 24 (four liquid containing vessels 24 in this embodiment) each capable of containing an ink are provided at a position that is located at the first edge side (the right-hand side in FIG. 1) in the long-side direction of the housing portion 14 and that is located outside the transportation route of the paper S. In addition, the plurality of liquid containing vessels 24 are each associated with a kind and a color of a corresponding one of inks used in the recording apparatus 1.

Hereinafter, a direction along the gravity direction will be made a Z direction (an upward/downward direction), and a direction intersecting with (being perpendicular to) the Z direction and corresponding to the long-side direction of the housing portion 14 will be made an X direction (a scanning direction). Further, a direction intersecting with (being perpendicular to) each of the Z direction and the X direction and corresponding to a short-side direction of the housing portion 14 will be made a Y direction. Moreover, viewing in the Z direction will be termed as "in a plan view".

As shown in FIG. 2, in the feeding portion 15, a rolled object R1 resulting from overlap-winding of unused paper S into a cylindrical state is held. In addition, the rolled object R1 has a plurality of sizes in the width (the X-direction length) of the paper S and the number of turns of the paper S, and in the feeding portion 15, the rolled object R1 is attached so as to be replaceable. Further, the rolled object R1 is attached in the feeding portion 15 so as to be in a state of being shifted to the first edge side (the right-hand side in FIG. 1) in the X direction, whichever one of the plurality of sizes the rolled object R1 has. That is, in the recording apparatus 1, a reference position for the alignment of the paper S is set to the first edge side in the X direction. Further, the feeding portion 15 rotates the rolled object R1 in a counterclockwise direction in FIG. 2, thereby allowing the paper S to be unwound from the rolled object R1 and be fed (transported) to the inside of the housing portion 14.

In the inside of the housing portion 14, there are contained a pair of transportation rollers 25 for transporting the paper S; a recording portion 26 for performing printing (recording) on the paper S which is transported in a transportation direction F by the pair of transportation rollers 25; a medium supporting portion 27 for supporting the paper S; and an absorbing mechanism 28 for absorbing the paper.

In addition, the transportation direction F is a direction along the Y direction and is an example of the "medium transportation direction" in the above some application examples of the invention.

In the recording portion 26, guide shafts 29 and 30 that are transversely disposed so as to extend in the X direction; a carriage 31 that is supported by the guide shafts 29 and 30; and a liquid ejecting portion 32 that is held at a bottom portion of the carriage 31 are provided. Further, the carriage 31 reciprocates along the guide shafts 29 and 30 within a movement area extending in the X direction (the scanning direction) perpendicular to the transportation direction F.

Further, in each of both X-direction edge portions of the guide shafts 29 and 30, an adjustment mechanism 33 for changing the height (the Z-direction position) of the liquid ejecting portion 32 and thereby adjusting a space distance between the liquid ejecting portion 32 and the paper S is provided. Further, in the bottom portion of the carriage 31, a reflection type sensor 34 is held at a more downstream-side position than the position of the liquid ejecting portion 32 in the transportation direction F.

The reflection type sensor 34 is an optical sensor including a light source portion and a light reception portion which are not illustrated. The reflection type sensor 34 performs a light detection operation by causing the light reception portion to receive reflected light of light that is emitted downward from the light source portion and outputting a detection value V (a voltage value) in accordance with a magnitude of the reflected light having been received by the light reception portion. Further, the control portion 22 calculates the width (the X-direction length) of the paper S by causing the reflection type sensor 34 to perform the light detection operation while moving the carriage 31 in the X direction (the scanning direction) and detecting positions at which a reflection target is changed, that is, the positions of the both edges of the paper S in the X direction, on the basis of the detection values V output from the reflection type sensor 34.

Further, the recording (printing) is performed by causing the liquid ejecting portion 32 to, in accordance with the detected width of the paper S, eject inks supplied from the liquid containing vessels 24 onto the paper S that is in the state of being transported along the transportation route. Further, printing-completed paper S is guided obliquely downward along the medium guiding portion 17, and then is formed into a rolled object R2 by being wound by the winding portion 16. At this time, the tension roller 20 presses the backside of the paper S that is in the state of hanging from the medium guiding portion 17 because of its own weight and thereby applies a tension to the paper S to be wound by the winding portion 16.

In addition, the recording apparatus 1 is configured to be also able to eject the paper S without winding the paper S into the rolled object R2. For example, the recording apparatus 1 is configured to be also able to contain the printing-completed paper S in an ejection basket (not illustrated) that is attached in substitution for the winding portion 16.

Outline of Medium Supporting Portion and Medium Holding Member

Figure 3:
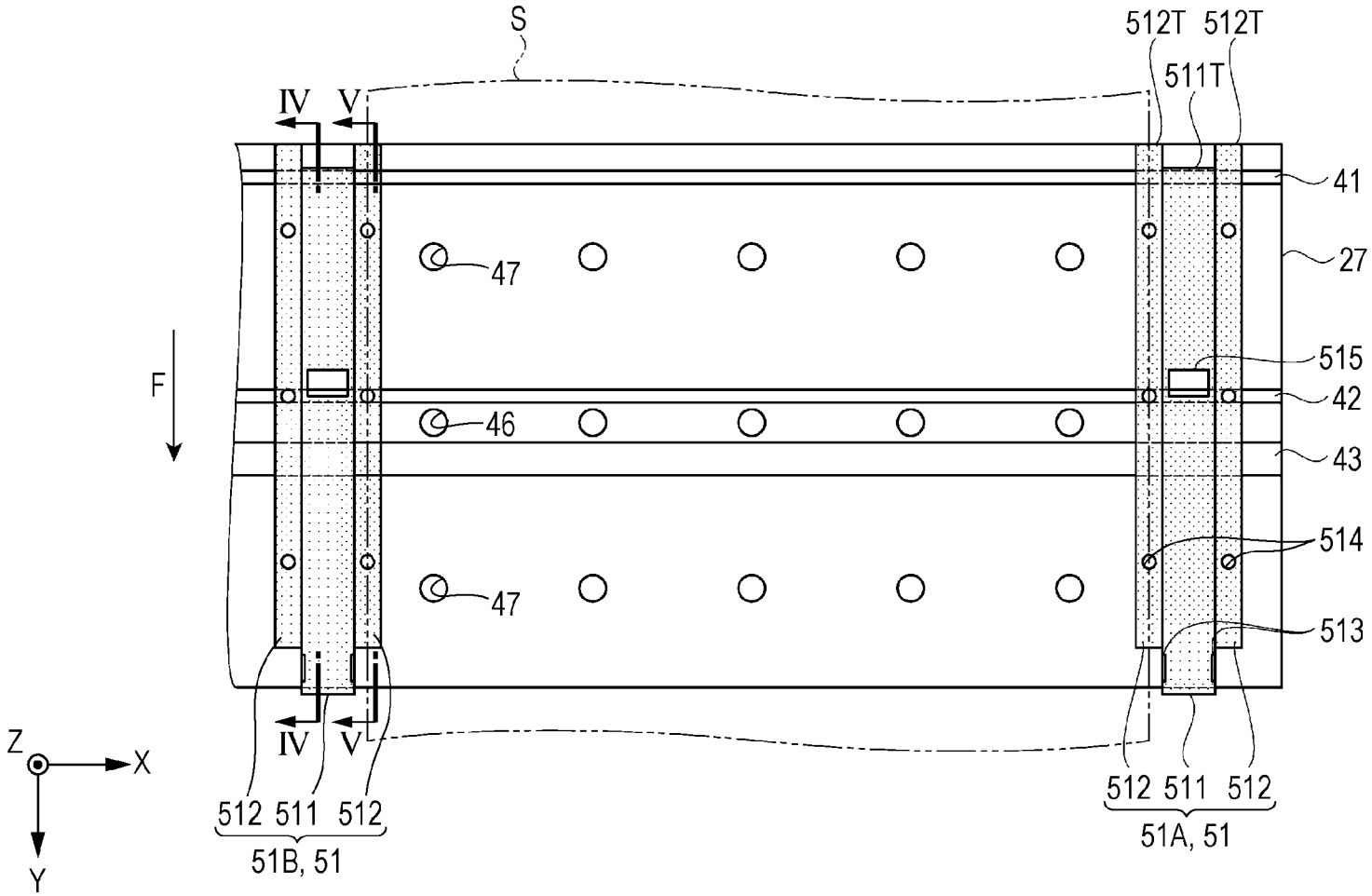
FIG. 3 is a schematic plan view illustrating a state of a medium supporting portion and medium holding members, which are included in an area enclosed by the dashed line A of FIG. 2.
Figure 4:
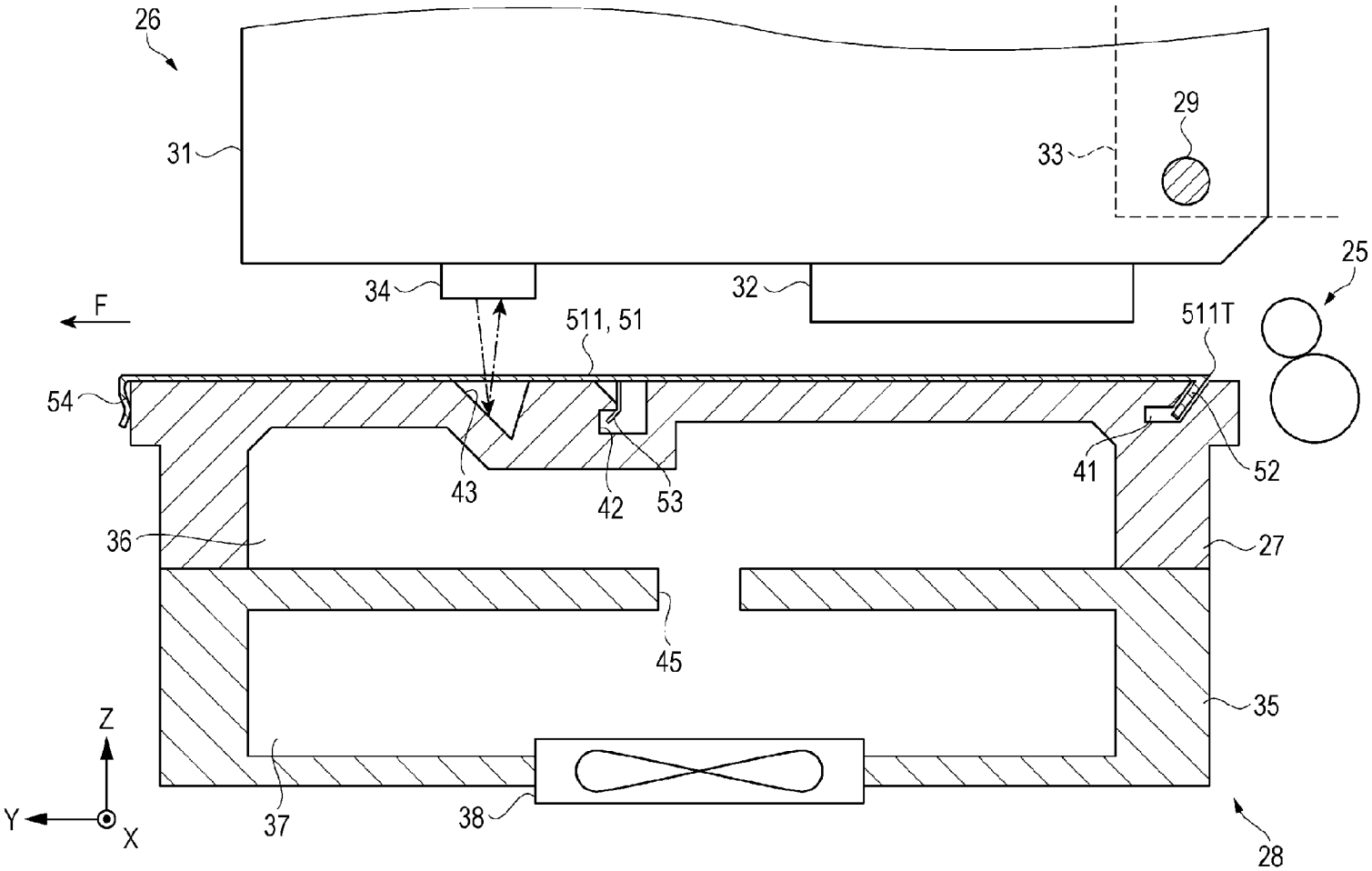
FIG. 4 is a schematic cross-sectional view taken along the line IV-IV of FIG. 3.
Figure 5:
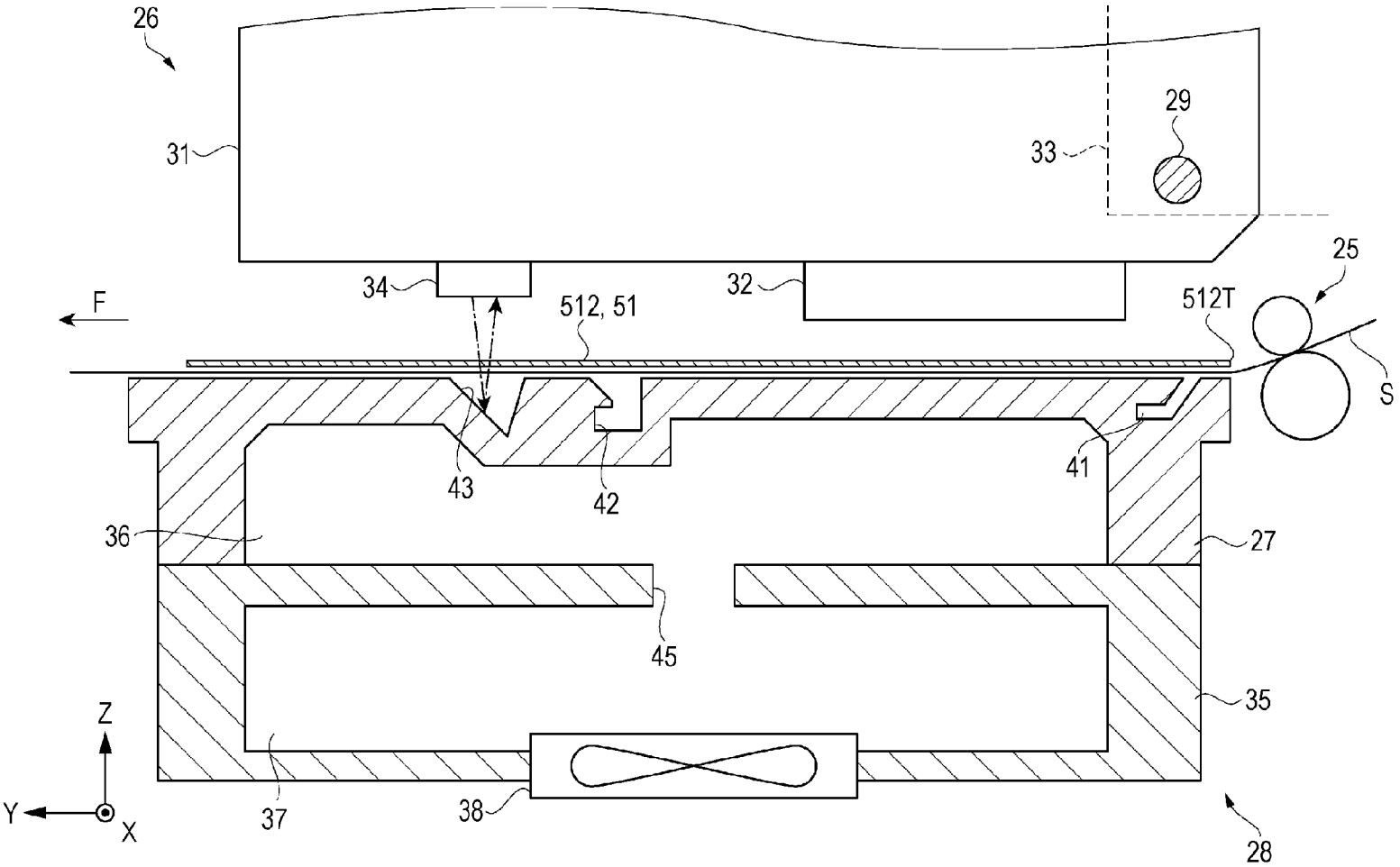
FIG. 5 is a schematic cross-sectional view taken along the line V-V of FIG. 3.
Figure 6:
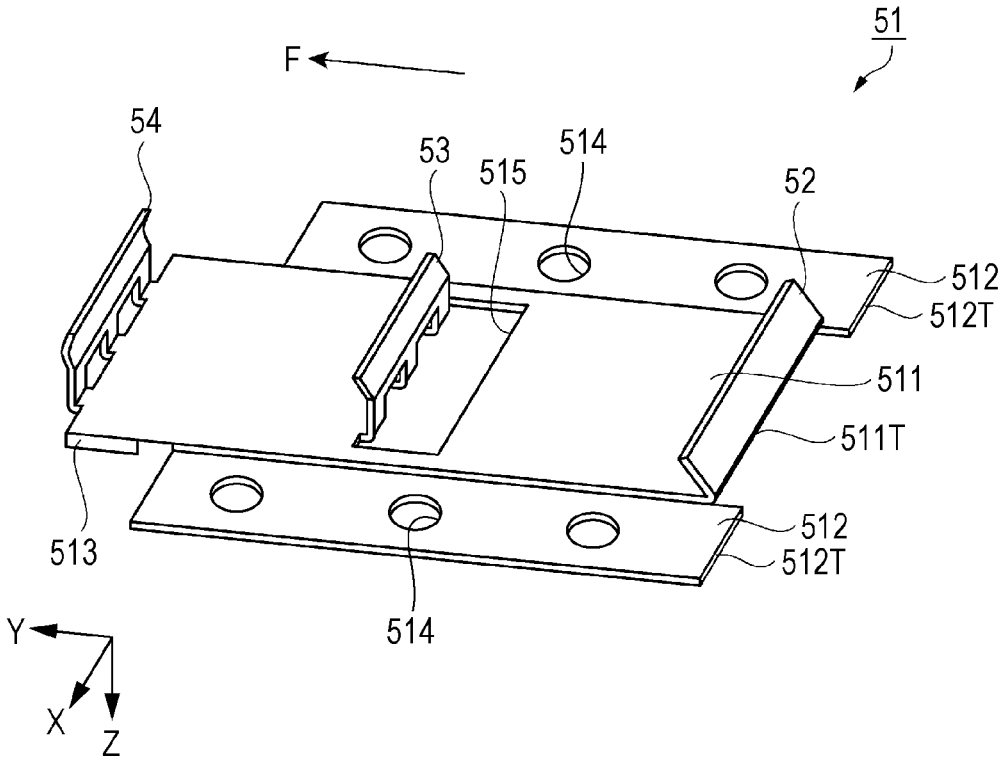
FIG. 6 is a perspective view of a medium holding member according to embodiment 1 of the invention.

FIG. 3 is a schematic plan view illustrating a state of a medium supporting portion and a medium holding member that are included in an area A enclosed by the dashed line of FIG. 2. FIG. 4 is a schematic cross-sectional view taken along the line IV-IV of FIG. 3. FIG. 5 is a schematic cross-sectional view taken along the line V-V of FIG. 3. FIG. 6 is a perspective view of a medium holding member according to this member.

In addition, in FIG. 4, an aperture 515 that is formed in a first portion 511 of a medium holding member 51 is omitted from illustration. FIG. 6 is a diagram when the medium holding member 51, which is illustrated in FIGS. 4 and 5, is viewed in a direction from the medium supporting portion 27 toward the carriage 31, and illustrates a state of a portion that constitutes the medium holding member 51 and that is contacted with the medium supporting portion 27.

Hereinafter, the outline of the medium supporting portion 27 and the medium holding member 51 will be described with reference to FIGS. 3 to 6.

As shown in FIG. 3, the medium supporting portion 27 includes a first groove portion 41, a second groove portion 42, and a reflection groove portion 43 that are each formed so as to extend in the X direction. The first groove portion 41 is formed at a more upstream-side position than the position of the second groove portion 42 in the transportation direction F, and the reflection groove portion 43 is formed at a more downstream-side position than the position of the second groove portion 42 in the transportation direction F. That is, in the medium supporting portion 27, the first groove portion 41, the second groove portion 42, and the reflection groove portion 43 are formed in this order in the transportation direction F.

In addition, the first groove portion 41 is an example of "a fitted portion into which a fitting portion of the medium holding member is fitted" in the appended claims of the invention. The second groove portion 42 is an example of "a concave portion that is latched together with a latching portion of the medium holding portion" in the appended claims of the invention.

A first medium holding member 51A and a second medium holding member 51B that constitute a pair of medium holding members 51 are each attached to a corresponding one of both X-direction edge portions of the medium supporting portion 27. The first medium holding member 51A is attached to the X(+) direction side of an area which exists on the medium supporting portion 27 and in which the paper S is transported, and the second medium holding member 51B is attached to the X(−) direction side of the area which exists on the medium supporting portion 27 and in which the paper S is transported.

With respect to the medium holding member 51, its size in the Y direction (the transportation direction F) is longer than its size in the X direction. The medium holding member 51 is constituted by a first portion 511 that is disposed in the middle of the medium holding member 51 and second portions 512 that are disposed so as to interpose the first portion 511 therebetween.

In a downstream side portion of the medium holding member 51 in the transportation F, the first portion 511 protrudes over the second portions 512 in a Y(+) direction. Further, nob portions 513 are each formed at a corresponding one of the both edges of the protruding portion of the first portion 511.

In an upstream side portion of the medium holding member 51 in the transportation F, the second portions 512 protrude over the first portion 511 in a Y(−) direction. An edge 512T of each of the second portions 512 of the medium holing member 51 is configured so as to be located at substantially the same position as that of the Y(−) direction side edge of the medium supporting portion 27 in a plan view. An edge 511T of the first portion 511 of the medium holing member 51 is configured so as to be located at the inner side (at the Y(+) direction side) of the Y(−) direction side edge of the medium supporting portion 27 in a plan view.

In addition, the edge 512T of each of the second portion portions 512 of the medium holing member 51 may be configured so as to be located at the same position as that of the edge 511T of the first portion 511 of the medium holing member 51 in the Y direction. For example, the edge 512T of each of the second portion portions 512 of the medium holing member 51 and the edge 511T of the first portion 511 of the medium holing member 51 may be configured so as to be located at substantially the same position as that of the edge of the medium supporting portion 27 in a plan view. For example, both of the edge 512T of each of the second portion portions 512 of the medium holing member 51 and the edge 511T of the first portion 511 of the medium holing member 51 may be configured so as to be located at the inner side of the edge of the medium supporting portion 27 in a plan view. For example, both of the edge 512T of each of the second portion portions 512 of the medium holing member 51 and the edge 511T of the first portion 511 of the medium holing member 51 may be configured so as to protrude outward over the edge of the medium supporting portion 27 in a plan view.

Each of the medium holding members 51 is capable of, in a state in which the nob portions 513 of the relevant medium holding member 51 are firmly grasped, being moved (slid) in a direction in which the first groove portion 41 and the second groove portion 42 extend (i.e., in the X direction). In the recording apparatus 1, the medium holding members 51 are used such that the position of the first medium holding member 51A is fixed and the position of the second medium holding member 51B is moved in the X direction. That is, in this embodiment, the distance between the first medium holding member 51A and the second medium holding member 51B is adjusted by moving the position of the second medium holding member 51B in the X direction.

Further, the aperture 515 is formed in the vicinity of the central portion of the first portion 511 of the medium holding member 51. The aperture 515 is formed in a portion where a second fixing member 53 described below (refer to FIG. 4) has been formed.

Further, a plurality of openings 514 is formed in each of the second portions 512 of the pair of medium holding members 51. Each of the both edges of the paper S is placed on the individual centers of the plurality of openings 514 provided in a corresponding one of two central side second portions 512 of the pair of medium holding members 51. Although details will be described below, each of the width edges of the paper S is interposed between the medium supporting portion 27 and a corresponding one of the two central side second portions 512 of the pair of medium holding members 51. That is, each of the both edges of the paper S is placed in a portion where a corresponding one of the two central side second portions 512 of the pair of medium holding members 51 overlaps the medium supporting portion 27 in a plan view. Thus, each of the both edges of the paper S can be viewed through the plurality of openings 514 provided in a corresponding one of the two central side second portions 512 of the pair of medium holding members 51.

There are various kinds in the size of the paper S and the paper S has various widths (X-direction lengths). When setting paper S having a size different from the size of currently used paper S, the distance between the first medium holding member 51A and the second medium holding medium 51B is adjusted by moving the position of the second medium holding member 51B in the X direction. The color of the paper S is, for example, white, and thus, the paper has a reflectance ratio that is higher than that of the medium supporting portion 27. Accordingly, it is possible to easily distinguish (view and recognize) the boundary between each of the both edges of the paper S and the medium supporting portion 27. The position of the second medium holding member 51B is adjusted to an appropriate position so that, in a plan view, a corresponding one of the both edges of the paper S can be placed on the individual centers of the plurality of openings 514 provided in the central side second portion 512 of the medium holding members 51B, while confirming the relevant edge of the paper S through the relevant individual plurality of openings 514. Further, it is also confirmed whether or not the first medium holding member 51A is located at a position appropriate to the size of the paper S, and when the first medium holding member 51A is not located at the appropriate position, the position of the first medium holing member 51A is also adjusted. As described above, in order to confirm whether or not the pair of medium holding members 51 are located at respective appropriate positions, the plurality of openings 514 are formed in each of the second portions 512 of the pair of medium holding members 51.

As shown in FIGS. 4 and 5, the medium supporting portion 27 forms a box shape having a bottom portion that is disposed at an upper side of the medium supporting portion 27 and that is fixed below a moving area of the carriage 31. Further, a box-shaped absorbing-chamber forming member 35 is attached to a lower portion of the medium supporting portion 27. Further, a negative pressure chamber 36 is formed by the medium supporting portion 27 and the absorbing chamber forming member 35.

The absorbing-chamber forming member 35 includes an absorbing chamber 37 that is communicated with the negative pressure chamber 36. That is, the negative pressure chamber 36 is communicated with the absorbing chamber 37 via an absorbing hole 45. Further, an exhaust fan 38 for exhausting air contained in the absorbing chamber 37 to the outside is attached to the absorbing-chamber forming member 35. In addition, the absorbing-chamber forming member 35 and the exhaust fan 38 constitute the absorbing mechanism 28.

Further, absorbing holes 46 and 47 (refer to FIG. 3) that are communicated with the negative chamber 36 are formed on a Z(+)-direction side face (a face at the paper S side) of the medium supporting portion 27. The paper S is configured so as to be held on the medium supporting portion 27 via the absorbing holes 46 and 47. That is, the paper S is absorbed to the medium supporting portion 27 by the absorbing mechanism 28, and thereby the distance between the paper S and the liquid ejecting portion 32 is kept constant. As a result, the ejection state of inks ejected from the liquid ejecting portion 32 onto the paper S becomes uniform, and this leads to printing of uniform images onto the paper S.

The medium supporting portion 27 includes the reflection groove portion 43 that is formed at a portion thereof facing the reflection type sensor 34. In this case, reflected light resulting from a reflection of light emitted from the reflection type sensor 34 at the reflection groove portion 43 has a reflection distance that is longer than that of reflected light resulting from a reflection of the light emitted from the reflection type sensor 34 at a face constituting the top face of the medium supporting portion 27 and extending in the transportation direction F. As described above, when the color of the paper S is white, the paper S has a reflectance ratio that is higher than that of the medium supporting portion 27. Thus, through the configuration in which the reflection groove portion 43 is made a target of the reflection of the light emitted from the reflection type sensor 34, the reflectance ratio of the reflected light resulting from the reflection at the reflection groove portion 43 becomes definitely lower than that of reflected light resulting from a reflection at the face of the paper S, and this leads to an improvement of an accuracy in detection of the paper S. Further, this improvement also leads to an improvement of an accuracy in calculation of the width of the paper S, and through a printing process in accordance with an accurate calculated width of the paper S, it becomes possible to eliminate the problem in that inks are adhered on the medium supporting portion 27 and the adhered inks stain the paper S in the state of being transported on the medium supporting portion 27.

As shown in FIGS. 4 to 6, a face constituting the bottom face of the first portion 511 of each of the pair of medium holding members 51 and extending in the transportation direction F is in contact with the face constituting the top face of the medium supporting portion 27 and extending in the transportation direction F. In the first portion 511 of each of the pair of medium holding members 51, a first fixing member 52, the second fixing member 53, and a third fixing member 54 are formed in this order in the transportation direction F.

In addition, the first fixing member 52 is an example of "a fitting portion" in the appended claims of the invention. The second fixing member 53 is an example of "a latching portion" in the appended claims of the invention. The third fixing member 54 is an example of "an engaging portion" in the appended claims of the invention.

The first fixing member 52 is formed by folding the upstream side edge portion of the first portion 511 of each of the pair of medium holding members 51 in the transportation direction F, toward the Z(−) direction side. The first fixing member 52 intersects with the Z direction, and inclines from the upstream side toward the downstream side in the transportation direction F. That is, the first fixing member 52 includes a portion that inclines from the upstream side toward the downstream side in the transportation direction F. An angle formed by the first fixing member 52 and the face constituting the bottom face of the first portion 511 and extending in the transportation direction F is an acute angle smaller than 90 degrees.

The first groove portion 41 includes a portion that inclines from the upstream side toward the downstream side in the transportation direction F, and a portion extending in the transportation direction F.

The first fixing member 52 is fit into the portion constituting the first groove portion 41 and inclining from the upstream side toward the downstream side in the transportation direction F. The first fixing member 52, which has the portion that inclines from the upstream side toward the downstream side in the transportation direction F, is capable of resisting a force acting in a direction perpendicular to the transportation direction F (i.e., a force acting in the Z(+) direction). That is, even when the force acting in the direction perpendicular to the transportation direction F (i.e., the force acting in the Z(+) direction) is applied to the first fixing member 52, it is possible to suppress the first fixing member 52 from lifting in the Z(+) direction. In other words, the first fixing member 52 is a male type fitting member and the first groove portion 41 is a female type fitting member, and the fit of the male type fitting member into the female type fitting member allows at least part of the upstream side edge portion of each of the pair of medium holding members 51 in the transportation direction F to be fixed to an upstream side edge portion of the medium supporting portion 27 in the transportation direction F, thereby making it possible to suppress each of the pair of medium holding members 51 from lifting in the Z(+) direction.

As described above, each of the pair of medium holding members 51 includes the fitting portion (i.e., the first fixing member 52) that is capable of being fit into the medium supporting portion 27 and that is located at at least part of the upstream side edge portion of the relevant medium holding member 51 in the transportation direction F.

The second fixing member 53 is formed in the vicinity of the central portion of the first portion 511 of the medium holding member 51. The second fixing member 53 is formed by notching a portion that is located in the vicinity of the center of the first portions 511 of each of the pair of medium holding members 51 and folding the notched portion toward the Z(−) direction side. As a result, the aperture 515 (refer to FIG. 3) is formed in the portion where the second fixing member 53 has been formed. In other words, it is possible to form the second fixing member 53 by notching and folding a material of a portion where the aperture 515 is located. The second fixing member 53 includes a portion perpendicular to the transportation direction F (i.e., a portion extending in the Z direction) and a portion intersecting with the transportation direction F (i.e., a portion inclined relative to the Z direction).

The second fixing member 53 is a kind of spring member (latching member) that is elastically deformed. The second fixing member 53 is fit into the second groove portion 42, and is latched (fixed) together with a convex portion constituting the second groove portion 42 and protruding in the Y(−) direction. That is, a spring energizing force caused by deforming the second fixing member 53 causes the second fixing member 53 to be latched (fixed) together with the convex portion constituting the second groove portion 42 and protruding in the Y(−) direction.

As described above, each of the pair of medium holding members 51 includes the latching portion (i.e., the second fixing member 53) that is capable of being latched together with the medium supporting portion 27 and that is located at a downstream side of the first fixing member 52 in the transportation direction F.

The third fixing member 54 is formed by folding a downstream side edge portion of each of the pair of medium holding members 51 in the transportation direction F, toward the Z(−) direction side. The third fixing member 54 is attached so as to firmly grasp the downstream side edge portion of the medium supporting portion 27 in the transportation direction F. The third fixing member 54 is a kind of spring member (engaging member) that is elastically deformed. A spring energizing force caused by deforming the third fixing material 54 causes the third fixing member 54 to be engaged with (fixed to) the downstream side edge of the medium supporting portion 27 in the transportation direction F.

As described above, each of the pair of medium holding members 51 includes the engaging portion (i.e., the third fixing member 54) that is capable of being engaged with the medium supporting portion 27 and that is located at at least part of the downstream side edge portion of the relevant medium holding member 51 in the transportation direction F.

Further, since the third fixing member 54 is attached so as to firmly grasp the downstream side edge of the medium supporting portion 27 in the transportation direction F, the third fixing member 54 protrudes over the edge of the medium supporting portion 27 in a plan view.

As described above, each of the pair of medium holding members 51 includes the fixing member 52, 53, and 54, which are capable of fixing the relevant medium holding member 51 to the medium supporting portion 27 and which are each located at a corresponding one of at least three positions, and is fixed to the medium supporting portion 27 by these fixing members 52, 53, and 54.

In addition, the first fixing member 52 also has elasticity, and thus, when the first fixing member 52 is caused to be deformed and fit into the portion constituting the first groove portion 41 and inclining from the upstream side toward the downstream side in the transportation direction F, an energizing force caused by the deformation of the first fixing member 52 makes it possible to more firmly fix the first fixing member 52 to the medium supporting portion 27.

Each of the second portions 512 of the pair of medium holding members 51 is disposed so as to be upwardly distanced from the medium supporting portion 27. That is, a gap is provided between each of the second portions 512 of the pair of medium holding members 51 and the medium supporting portion 27. Each of the both edges of the paper S passes through the gap between the medium supporting portion 27 and the central side second portion 512 of a corresponding one of the pair of medium holding members 51. That is, the paper S is transported in the transportation direction F so as to be in a state in which each of the both edges of the paper S is interposed between the medium supporting portion 27 and the central side second portion 512 of a corresponding one of the pair of the medium holding members 51.

The upstream side edge 512T of the central side second portion 512 of each of the pair of medium holding members 51 becomes a paper transportation inlet (a receiving portion for the paper S). That is, the pair of medium holding members 51 includes the receiving portion for the paper S, which is capable of receiving the paper S and is disposed between the medium supporting portion 27 and the edge 512T of the central side second portion 512, at at least part of the upstream side edge portion of the pair of medium holding members 51 in the transportation direction F. Further, the downstream side edge of the central side second portion 512 of each of the pair of medium holding members 51 becomes a paper transportation outlet.

In addition, the gap between the medium supporting portion 27 and the upstream side edge 512T of the relevant second portion 512 of each of the pair of medium holding members 51 is an example of "a medium receiving portion" in the appended claims of the invention.

As described above, the edge 512T of each of the second portions 512 of the pair of medium holding portions 51 is disposed at substantially the same position as that of the edge of the medium supporting portion 17 in a plan view. In this embodiment, the receiving portion for the paper S is located nearer the pair of transportation rollers 25, as compared with a case where the edge 512T of each of the second portions 512 of the pair of medium holding portions 51 is disposed at an inner side of the edge of the medium supporting portion 27.

Problems of Existing Recording Apparatuses

As described above, there are various kinds in the width (X-direction length) of the paper S that is attached in the recording apparatus 1, and thus, an operation of switching the paper S frequently occurs in the recording apparatus 1. In the recording apparatus 1, after the completion of switching to given paper S, the paper S is unwound from the rolled object R1, and the unwound paper S is fed to the medium supporting portion 27 (the recording portion 26), where inks are ejected onto the paper S from the liquid ejecting portion 32 and thereby given images are printed on the paper S.

There are various kinds in the property of a constituent material of the paper S. That is, there exist a soft material, a hard material, a thin material, thick material, and the like, as the constituent material of the paper S. When the paper S is unwound from the pair of transportation rollers 25 and is transported to the medium supporting portion 27, the paper S is likely to warp in the Z(+) direction or in the Z(−) direction because of a curling tendency of the paper S due to the influence of the shape of the rolled object R1 resulting from overlap-winding of the paper S in a cylindrical state. For example, the paper S that is made of a hard material or a thick material is more likely to warp in the Z(+) direction because of the curling tendency, as compared with the paper S that is made of a soft material or a thin material.

Figure 7:
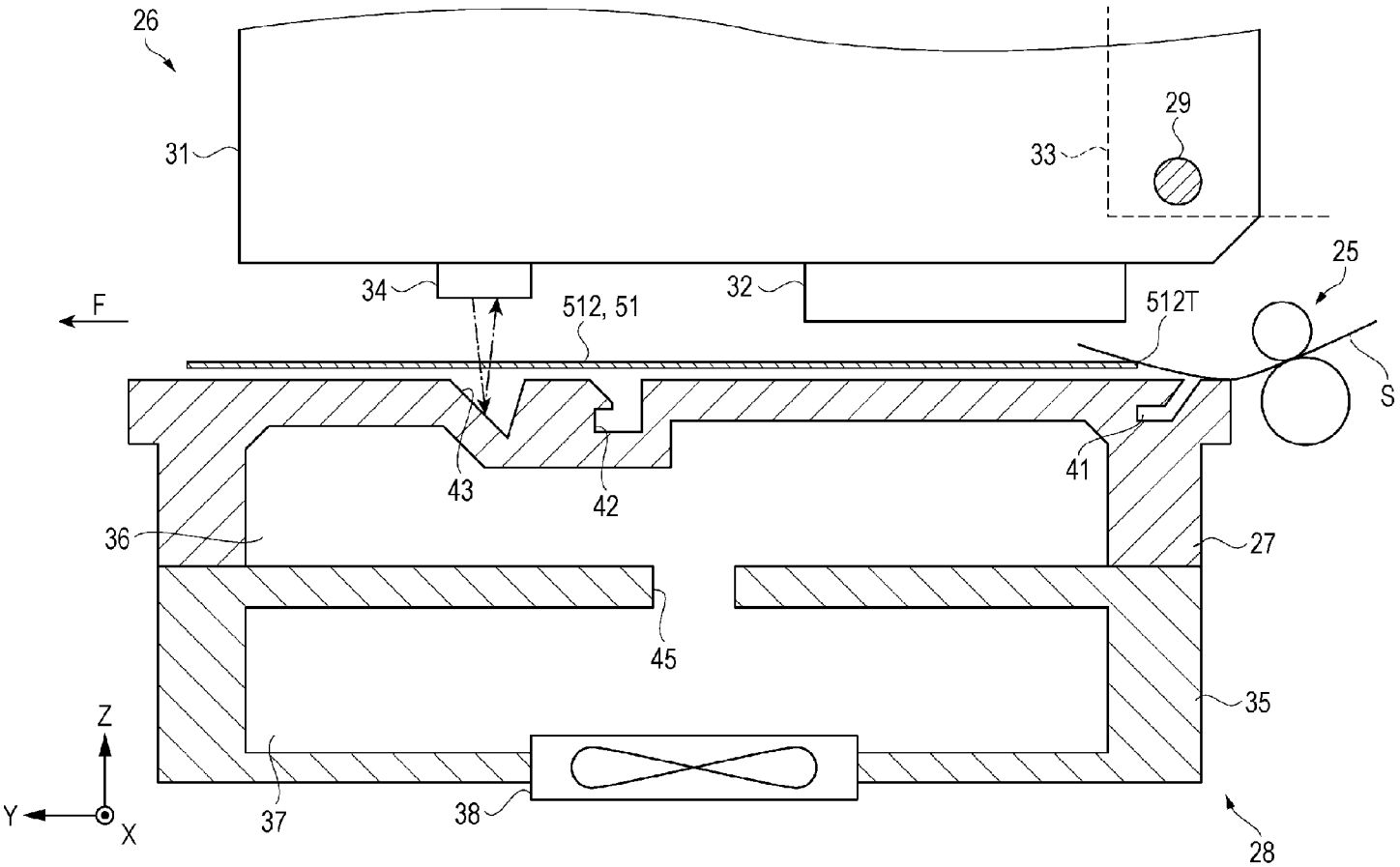
FIG. 7 is a schematic diagram that describes problems of existing recording apparatuses.

FIG. 7 is a diagram corresponding to FIG. 5, and is a schematic diagram that describes problems of existing recording apparatuses. The upstream side edge 512T of each of the second portions 512 of the pair of medium holding members 51 in the transportation direction F is disposed at an inner side of the medium supporting portion 27 (disposed at a position distanced from the pair of transportation rollers 25). Moreover, in FIG. 7, the upstream side edge portion of each of the pair of medium holding members 51 in the transportation direction F is not fixed to the medium supporting portion 27.

As shown in FIG. 7, when the paper S warps in the Z(−) direction because of the curling tendency of the paper S, the paper S having been fed (transported) from the pair of transportation rollers 25 interferes with (comes into contact with) the medium supporting portion 27, thereby causing a force acting in the Z(+) direction that is applied to the paper S from the medium supporting portion 27 and, as a result, the edge portion of the paper S lifts in the Z(+) direction. When the edge portion of the paper S lifts (warps) in the Z(+) direction, as a result, the paper S does not pass through the receiving portions for the paper S (i.e., the gaps between the edges 512T of the two central side second portions 512 of the pair of medium holding members 51 and the medium supporting portion 27), but passes on the receiving portions for the paper S. Further, when the paper S passes on the receiving portions for the paper S, the paper S interferes with the liquid ejecting portion 32, thereby causing the possibility that a defect (failure) occurs in the liquid ejecting portion 32.

When the paper S is in the state of warping in the Z(+) direction because of the curling tendency of the paper S, the paper S does not pass through the receiving portions for the paper S, but passes on the receiving portions for the paper S. As a result, the paper S interferes with the liquid ejecting portion 32, thereby causing the possibility that a defect (failure) occurs in the liquid ejecting portion 32.

Moreover, when the paper S does not pass through the receiving portions for the paper S, but passes on the receiving portions for the paper S, the distance between the paper S and the liquid ejecting portion 32 becomes unequal, and this makes the uniformity of the inks ejected from the liquid ejecting portion 32 worse, thereby causing the possibility of degradation of a printing quality.

As described above, the paper S (the edge of the paper S) having been fed (transported) from the pair of transportation rollers 25 is likely to lift (warp) in the Z(+) direction because of the curling tendency of the paper S. When the edge of the paper S lifts in the Z(+) direction and the paper S interferes with (comes into contact with) at least one of the medium holding portions 51 (at least one of the edges 512T of the second portions 512 of the pair of medium holding members 51), a force acting in the Z(+) direction is applied to the relevant medium holding portion 51 from the paper S.

In the configuration shown in FIG. 7, since the upstream side edge portion of each of the pair of medium holding members 51 in the transportation direction F is not fixed to the medium supporting portion 27, the upstream side edge portion of each of the pair of medium holding members 51 in the transportation direction F is likely to lift in the Z(+) direction because of the force acting in the Z(+) direction, thereby causing the possibility that at least one of the medium holding members 51 interferes with the liquid ejecting portion 32 and, as a result, a defect (failure) occurs in the liquid ejecting portion 32.

Moreover, the paper S that is made of a hard material or a thick material is more likely to warp in the Z(+) direction, as compared with the paper S that is made of a soft material or a thin material. Thus, as compared with the paper S that is made of a soft material or a thin material, the paper S that is made of a hard material or a thick material is more largely influenced by the curling tendency of the paper S and, as a result, a defect (failure) of the liquid ejecting portion 32, degradation of a quality of recorded images, and the like, are more likely to occur.

Advantageous Effects Brought about by Medium Holding Member and Medium Supporting Portion The following advantageous effects are brought about by the pair of medium holding members 51 and the medium supporting portion 27.

(1) The receiving portions for the paper S (i.e., the gaps between the medium supporting portion 27 and the edges 512T of the two central side second portions 512 of the pair of medium holding members 51) are configured so as to be disposed nearer the pair of transportation rollers 25, and thus, the influence of the curling tendency of the paper S becomes smaller, thereby making it easy for the paper S to enter the receiving portions for the paper S, as compared with the configuration shown in FIG. 7. Accordingly, as compared with the configuration shown in FIG. 7, the paper S more stably passes through the gaps between the medium supporting portion 27 and the relevant two second portions 512 of the pair of medium holding members 51, thereby making it possible to suppress the paper S from warping (lifting) in the direction Z(+).

(2) The edge 511T of each of the pair of medium holding members 51 (i.e., the upstream side edge portion of the first portion 511 of each of the pair of medium holding members 51 in the transportation direction F) is fixed to the medium supporting portion 27 by the first fixing member 52, and thus, even when a force acting in the Z(+) direction is applied to the pair of medium holding members 51 from the paper S, it is possible to suppress each of the edges 512T of the pair of medium holding members 51 from lifting in the Z(+) direction.

(3) Each of the pair of medium holding members 51 is fixed to the medium supporting portion 27 at, in addition to the upstream side portion of the relevant medium holding member 51 in the transportation direction F (i.e., the portion where the first fixing member 52 is formed), the downstream side portion of the relevant medium holding member 51 in the transportation direction F (i.e., the portion where the third fixing member 54 is formed), and the portion between the first fixing member 52 and the third fixing member 54 (i.e., the portion where the second fixing member 53 is formed). Accordingly, as compared with a case where the each of the pair of medium holding members 51 is fixed to the medium supporting portion 27 at only the upstream side portion of the relevant medium holding member 51 in the transportation direction F, the pair of medium holding members 51 are more firmly fixed to the medium supporting portion 27, and thus, the position of each of the pair of medium holding members 51 is unlikely to vary even though an external force is applied thereto.

(4) It is possible to, during an operation of switching the paper S, easily confirm whether or not the positions of the pair of medium holding members 51 have been adjusted to appropriate positions, by forming the plurality of openings 514 in each of the second portions 512 of the pair of medium holding members 51. That is, it is possible to adjust the positions of the pair of medium holding members 51 so that each of the both edges of the paper S can be certainly pinched by a corresponding one of the pair of medium holding members 51 and the medium supporting portion 27.

(5) The methods described in the above (1) to (4) allow the both edges of the paper S to stably pass through the gaps between the medium supporting portion 27 and the two central side second portions 512 of the pair of medium holding members 51, thereby making it possible to stably suppress the paper S from warping (lifting) in the Z(+) direction. Accordingly, the methods described in the above (1) to (4) make it possible to suppress the possibility that the paper S and the liquid ejecting portion 32 interfere with each other and this interference causes a failure in the liquid ejecting portion 32.

Additionally, the methods described in the above (1) to (4) make it possible to suppress the occurrence of the inequality of the gap between the paper S and the liquid ejecting portion 32 and thereby suppress the degradation of a quality of images printed on the paper S.

(6) The Z(+)-direction lift of each of the edges 512T of the pair of medium holding members 51 is suppressed, and thus, it is possible to suppress the possibility that at least one of the medium holding members 51 and the liquid ejecting portion 32 interfere with each other and this interference causes a failure in the liquid ejecting portion 32.

Modification Example of Embodiment 1

Figure 8:
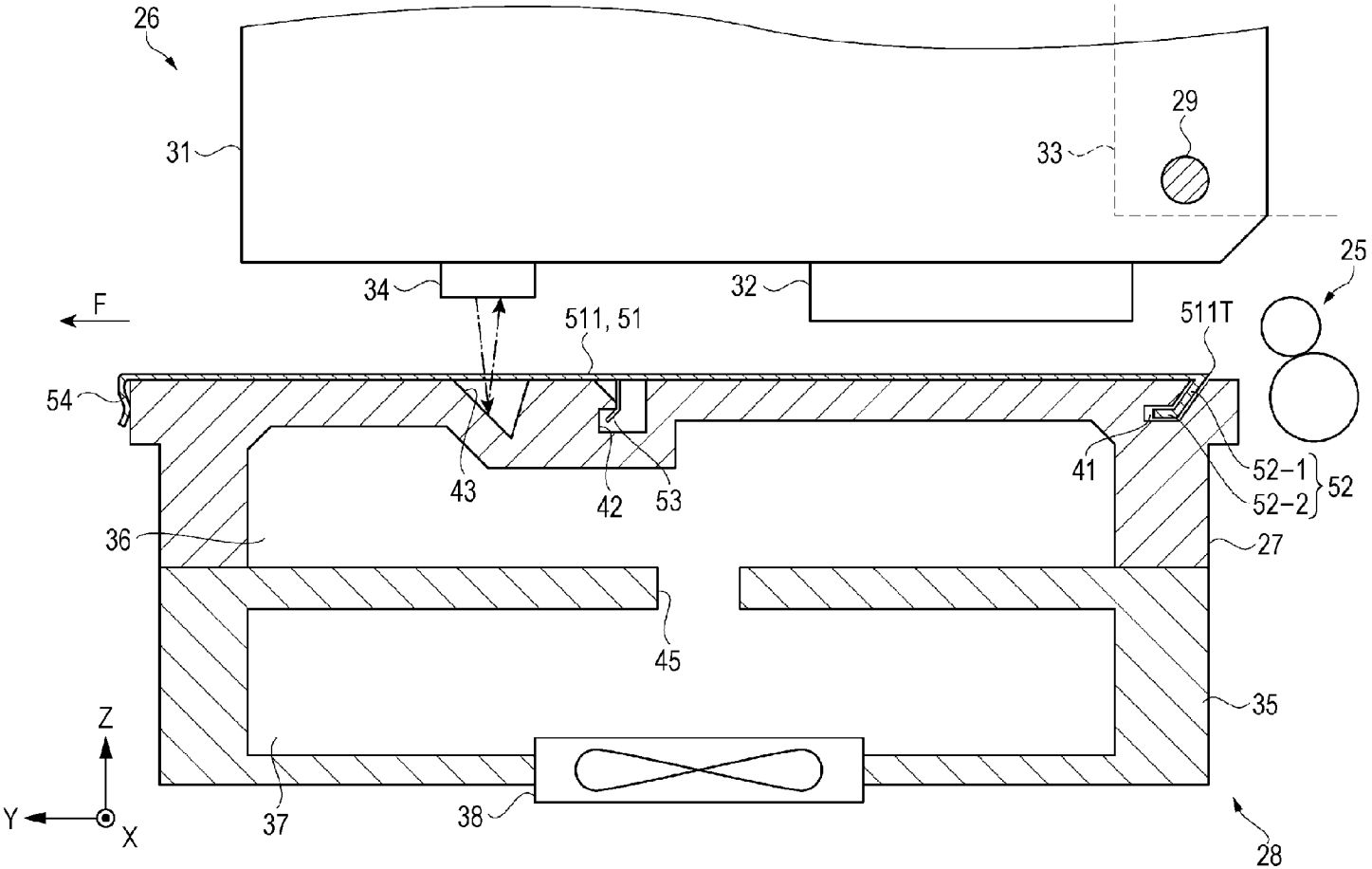
FIG. 8 is a schematic cross-sectional view of an area in which a medium holding member according to a modification example of embodiment 1 of the invention is attached.

FIG. 8 is a diagram corresponding to FIG. 4 and is a schematic cross-sectional view of an area in which a medium holding member according to a modification example of embodiment 1 is attached.

In this modification example, a first fixing member 52A that is formed in each of a pair of medium holding members 51 is different from the case of embodiment 1. Configurations other than this different point in this modification example are the same as those of embodiment 1.

Hereinafter, while referring to FIG. 8, a recording apparatus according to this modification example will be described focusing around the different point between the recording apparatus according to this modification example and the recording apparatus 1 according to embodiment 1. Further, in this modification example, constituent members identical to the constituent members of embodiment 1 are denoted by reference signs identical to those of the constituent members of embodiment 1, and thereby duplicated descriptions are omitted.

As shown in FIG. 8, the first fixing member 52A includes a portion 52-1 inclining from the upstream side toward the downstream side in the transportation direction F and a portion 52-2 extending in the transportation direction F. The portion 52-1 inclining from the upstream side toward the downstream side in the transportation direction F corresponds to the first fixing member 52 in embodiment 1. That is, a member resulting from adding the portion 52-2 extending in the transportation direction F to the first fixing member 52 of embodiment 1 is the first fixing member 52A of this modification example.

The portion 52-2 extending in the transportation direction F is capable of more strongly resisting a force acting in a direction perpendicular to the transportation direction F (i.e., a force acting in the Z(+) direction), as compared with the portion 52-1 intersecting with the transportation direction F and inclining from the upstream side toward the downstream side in the transportation direction F. Accordingly, in this modification example, it is possible to more strongly suppress an upstream side edge portion of each of the pair of medium holding members 51 in the transportation direction F from lifting in the direction perpendicular to the transportation direction F (i.e., in the Z(+) direction).

Embodiment 2

Figure 9:
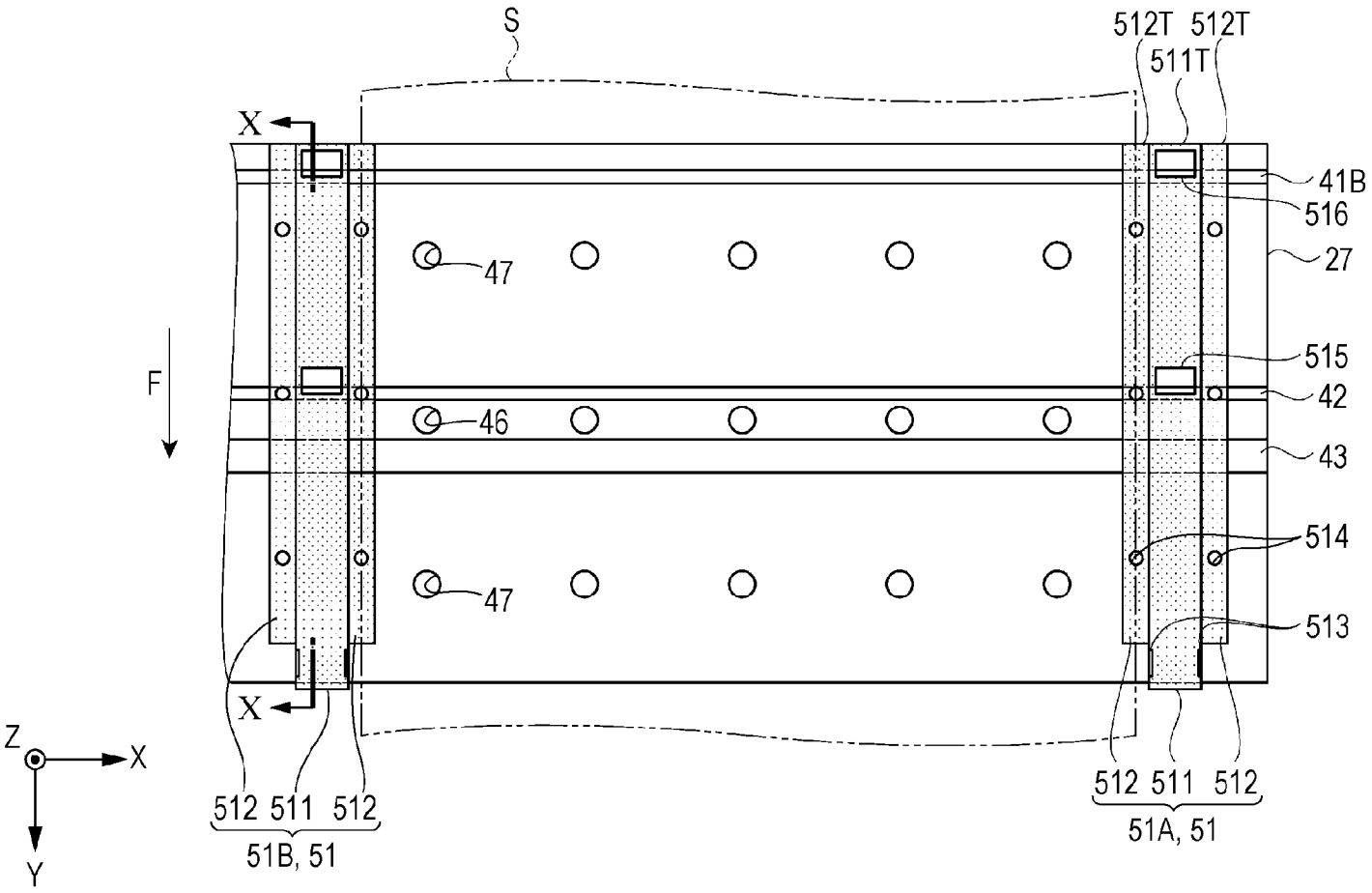
FIG. 9 is a schematic plan view illustrating a state of a medium supporting portion and medium holding members, according to embodiment 2 of the invention.
Figure 10:
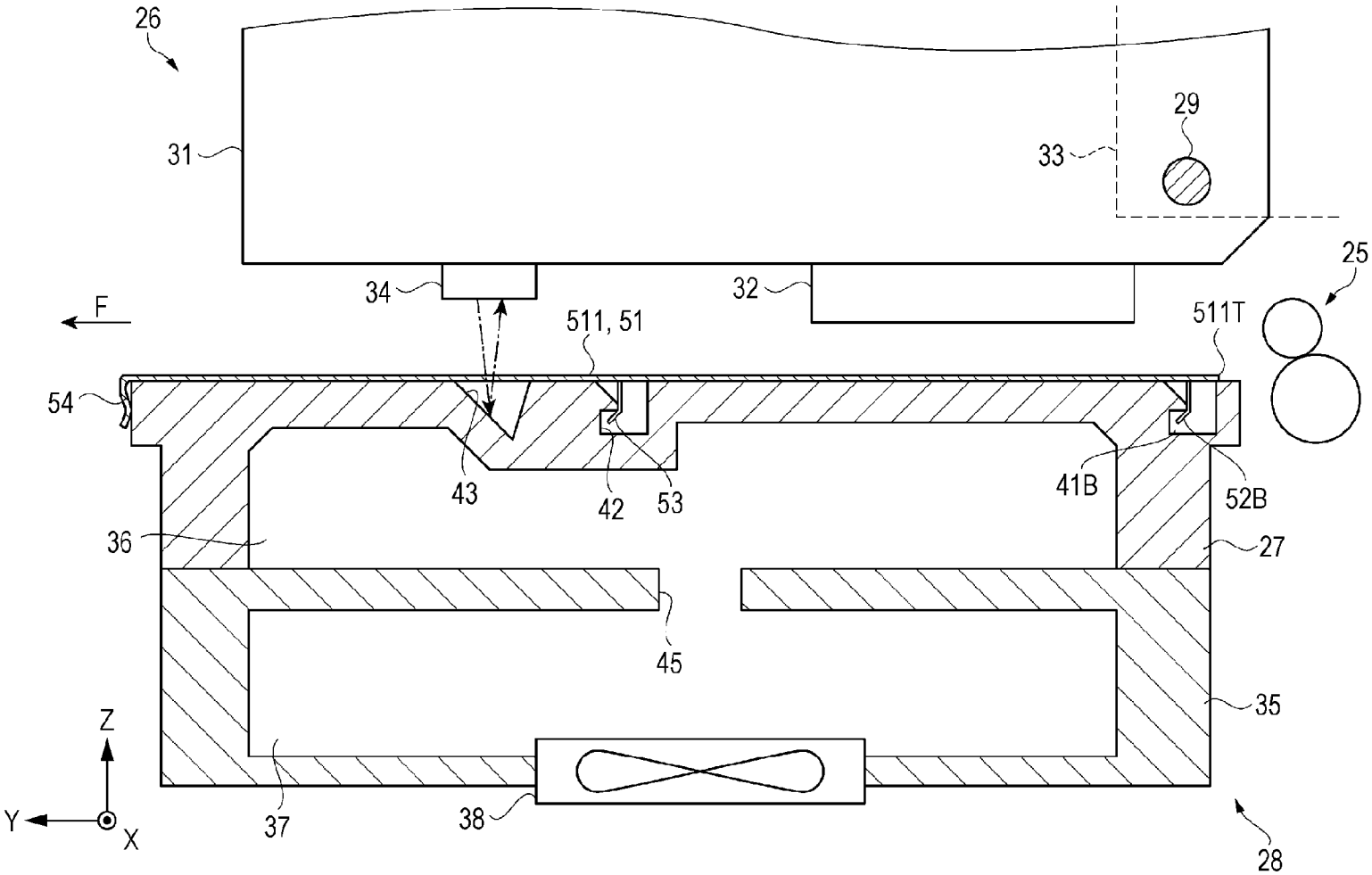
FIG. 10 is a schematic cross-sectional view taken along the line X-X of FIG. 9.
Figure 11:
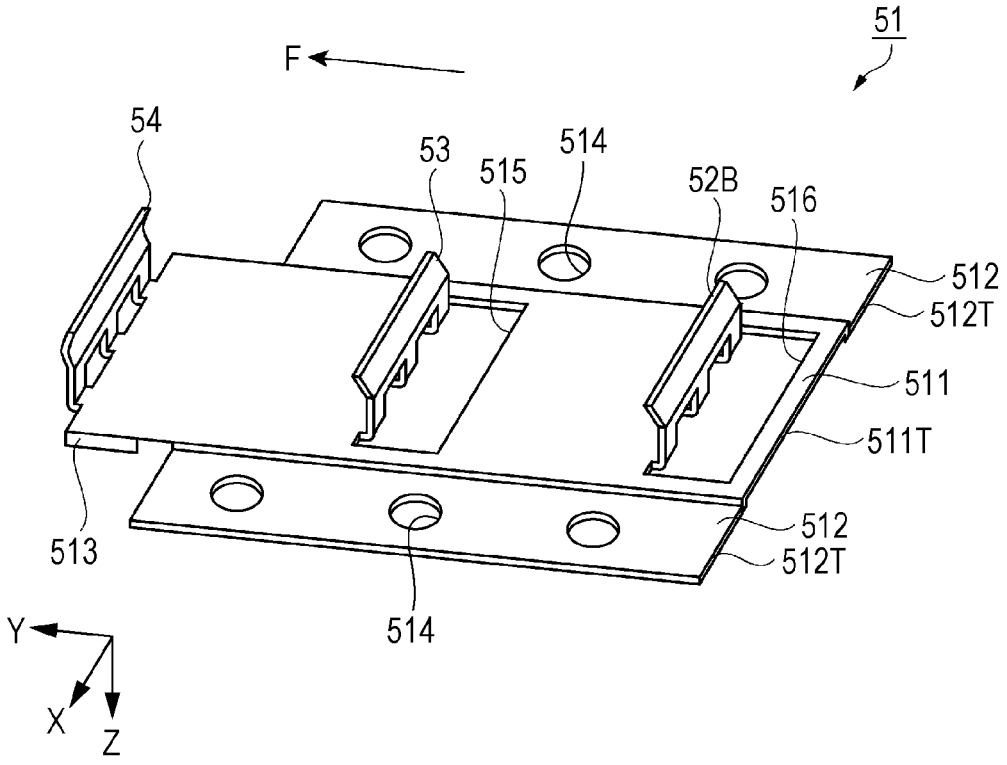
FIG. 11 is a perspective view of a medium holding member according to embodiment 2 of the invention.

FIG. 9 is a diagram corresponding to FIG. 3 and is a schematic plan view illustrating a state of a medium supporting portion and medium holding mediums, according to embodiment 2. FIG. 10 is a schematic cross-sectional view taken along the line X-X of FIG. 9. FIG. 11 is a diagram corresponding to FIG. 6 and is a perspective view of the medium holding member according to this embodiment.

In addition, in FIG. 10, apertures 515 and 516 that are formed in a first portion 511 of each of a pair of medium holding members 51 are omitted from illustration.

In this embodiment, both of the shape of a first fixing member 52B that is formed in each of the pair of medium holding members 51 and the shape of a first groove portion 41B that is formed in a medium supporting portion 27 are different from the case of embodiment 1. Configurations other than these different points in this embodiment are the same as those of embodiment 1.

Hereinafter, while referring to FIGS. 9 and 10, a recording apparatus according to this embodiment will be described focusing around the different points between the recording apparatus according to this embodiment and the recording apparatus 1 according to embodiment 1. Further, in this embodiment, constituent members identical to the constituent members of embodiment 1 are denoted by reference signs identical to those of the constituent members of embodiment 1, and thereby duplicated descriptions are omitted.

As shown in FIG. 9, the aperture 516 is provided in an upstream side edge portion of each of the pair of medium holding members 51 in the transportation direction F. The first fixing member 52B is formed by notching a portion that is located in the vicinity of an upstream side portion of each of the pair of medium holding members 51 in the transportation direction F, and further folding the notched portion toward the Z(−) direction side. As a result, the aperture 516 is formed in the vicinity of the upstream side portion of each of the pair of medium holding members 51 in the transportation direction F.

In an upstream side portion in the transportation direction F, both of an edge 512T of each of second portions 512 of each of the pair of medium holding members 51 and an edge 511T of the first portion 511 of each of the pair of medium holding members 51 are disposed at substantially the same position as that of the edge of the medium supporting portion 27 in a plan view.

As shown in FIGS. 10 and 11, the first fixing member 52B includes a portion extending in a direction perpendicular to the transportation direction F (i.e., a portion extending in the Z direction) and a portion extending in a direction intersecting with the transportation direction F (i.e., a portion inclining relative to the Z direction). The first fixing member 52B has substantially the same shape as that of the second fixing member 53. Moreover, the first groove portion 41B has the same shape as that of the second groove portion 42, and includes a convex portion protruding in the Y(−) direction on the downstream side face of the first groove portion 41B in the transportation direction F.

The first fixing member 52B is a kind of spring member (latching member) that is elastically deformed. The first fixing member 52B is fit into the first groove portion 41B, and is latched (fixed) together with the convex portion constituting the first groove portion 41B and protruding in the Y(−) direction. That is, a spring energizing force caused by deforming the first fixing member 52B causes the first fixing member 52B to be latched (fixed) together with the convex portion constituting the first groove portion 41B and protruding in the Y(−) direction.

In this embodiment, the spring energizing force caused by deforming the first fixing member 52B allows the upstream side edge portion of each of the pair of medium holding members 51 in the transportation direction F to be more firmly fixed to the medium supporting portion 27 and thereby makes it possible to more strongly suppress the upstream side edge portion of each of the pair of medium holding members 51 in the transportation direction F from lifting in the Z(+) direction, as compared with the case of embodiment 1. Accordingly, it is possible to more strongly suppress the occurrence of a defect (a failure of the liquid ejecting portion 32) due to the interference between at least one of the medium holding members 51 and the liquid ejecting portion 32.

Embodiment 3

Figure 12:
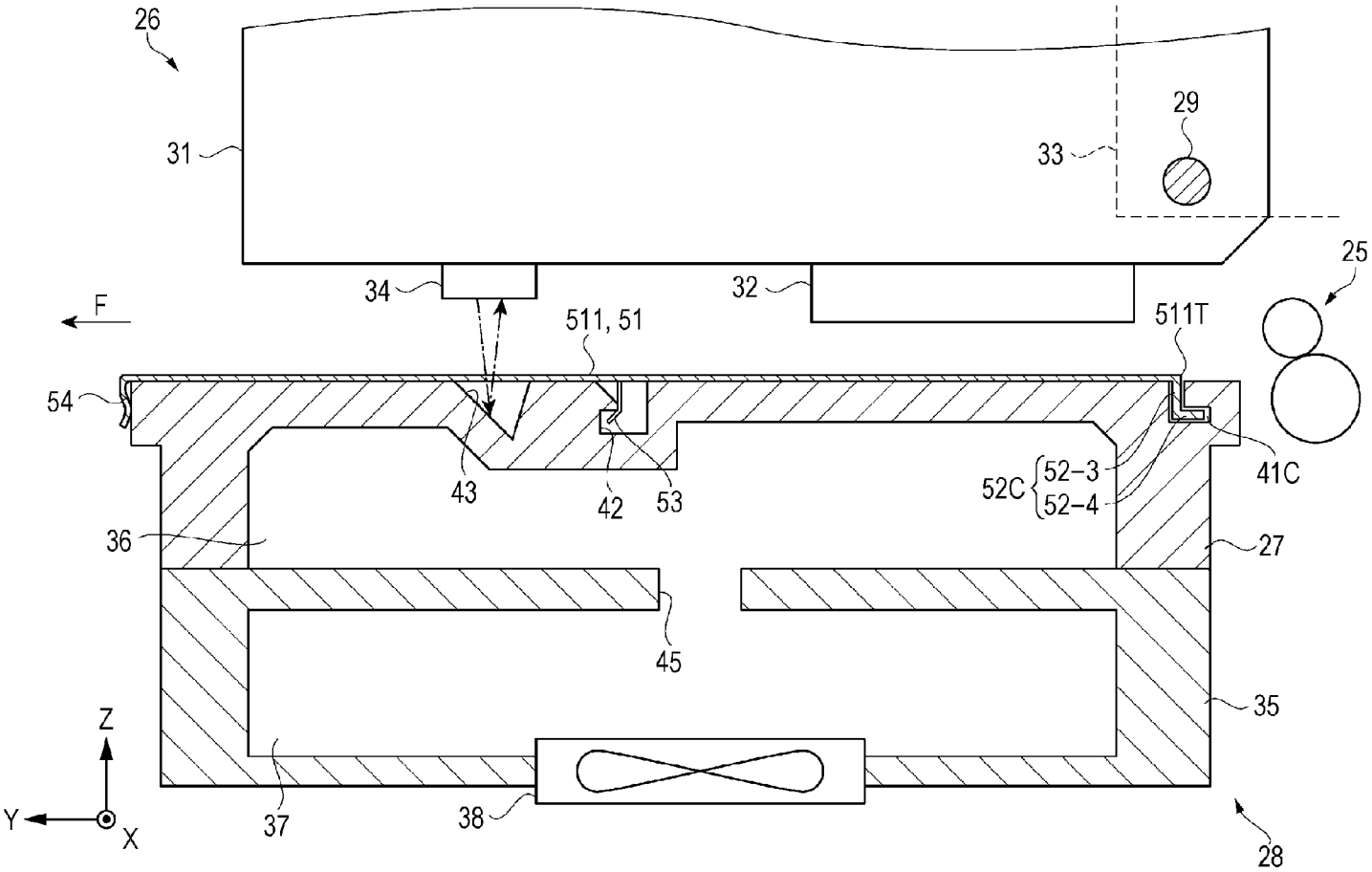
FIG. 12 is a schematic cross-sectional view of an area in which a medium holding member according to embodiment 3 of the invention is attached.
Figure 13:
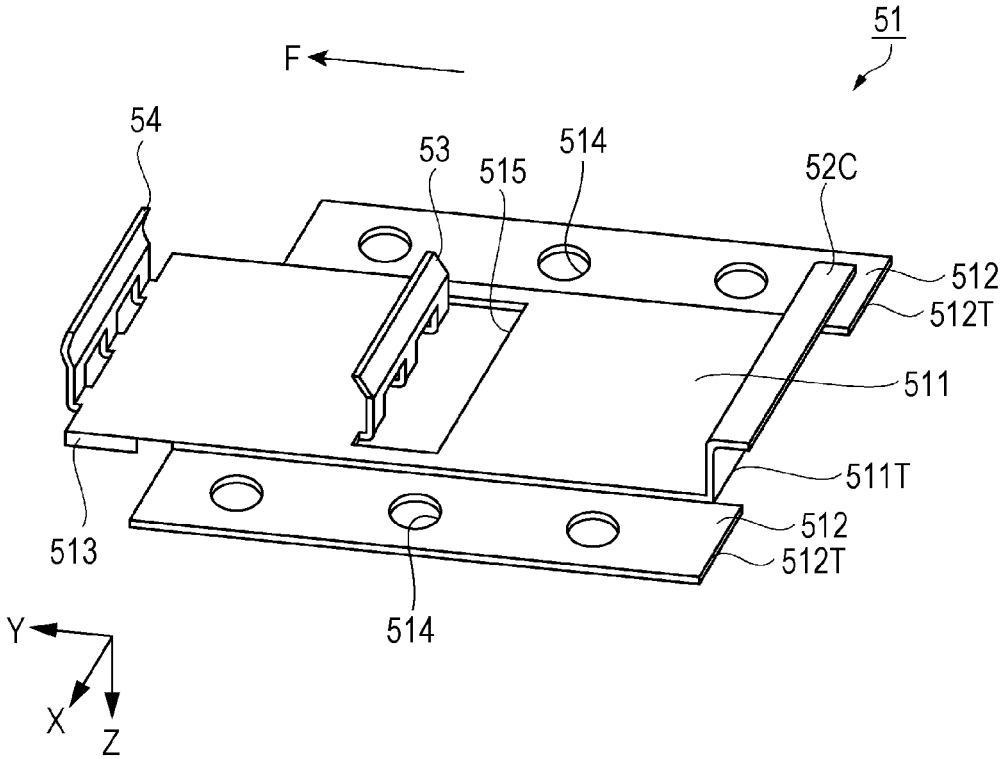
FIG. 13 is a perspective view of a medium holding member according to embodiment 3 of the invention.

FIG. 12 is a diagram corresponding to FIG. 4 and is a schematic cross-sectional view of an area in which a medium holding member according to embodiment 3 is attached. FIG. 13 is a diagram corresponding to FIG. 6 and is a perspective view of the medium holding member according to this embodiment.

In this embodiment, both of the shape of a first fixing member 52C that is formed in each of the pair of medium holding members 51 and the shape of a first groove portion 41C that is formed in the medium supporting portion 27 are different from the case of embodiment 1. Configurations other than these different points in this embodiment are the same as those of embodiment 1.

Hereinafter, while referring to FIGS. 12 and 13, a recording apparatus according to this embodiment will be described focusing around the different points between the recording apparatus according to this embodiment and the recording apparatus 1 according to embodiment 1. Further, in this embodiment, constituent members identical to the constituent members of embodiment 1 are denoted by reference signs identical to those of the constituent members of embodiment 1, and thereby duplicated descriptions are omitted.

As shown in FIGS. 12 and 13, the first fixing member 52C includes a portion 52-3 extending in a direction perpendicular to the transportation direction F (i.e., a portion extending in the Z(−) direction), and a portion 52-4 extending in the transportation direction F (i.e., a direction perpendicular to the Z direction). That is, the first fixing member 52C has an L-shaped cross section.

The first grove portion 41C includes a portion extending in a direction perpendicular to the transportation direction F (i.e., a portion extending in the Z direction), and a portion extending in the transportation direction F (i.e., a portion extending a direction perpendicular to the Z direction). That is, the first groove portion 41C has a shape (the L-shaped cross section) into which the first fixing member 52C can be fit.

In this embodiment, the fixing member 52C is fixed to the medium supporting portion 27 by fitting the first fixing member 52C into the first groove portion 41C.

In embodiment 1, the first fixing member 52 and the first groove portion 41 are configured so as to form fitting members each including a portion of a shape inclining from the upstream side toward the downstream side in the transportation direction F, that is, the fixing member 52 and the first groove portion 41 are configured so as to form fitting members each including a portion of a shape extending in a direction intersecting with the transportation direction F, and each of the pair of medium holding members 51 is fixed to the medium supporting portion 27 by fitting the first fixing member 52 into the first groove portion 41.

In this embodiment, the first fixing member 52C and the first groove portion 41C are configured so as to form fitting members each including a portion of a shape extending in the transportation direction F (i.e., a shape extending in a direction perpendicular to the Z direction). As compared with the configuration of embodiment 1, in which there are provided fitting members each including a portion of a shape intersecting with the transportation direction F, the configuration of this embodiment, in which there are provided fitting members each including a portion of a shape extending in the transportation direction F (i.e., a shape extending in the direction perpendicular to the Z direction), are capable of more strongly resisting the force acting in the direction perpendicular to the transportation direction F (i.e., the force acting in the Z(+) direction). Accordingly, in this embodiment, it is possible to more strongly suppress the upstream side portion of each of the pair of medium holding members 51 in the transportation direction F from lifting in the Z direction, as compared with the case of embodiment 1.

Modification Example of Embodiment 3

Figure 14:
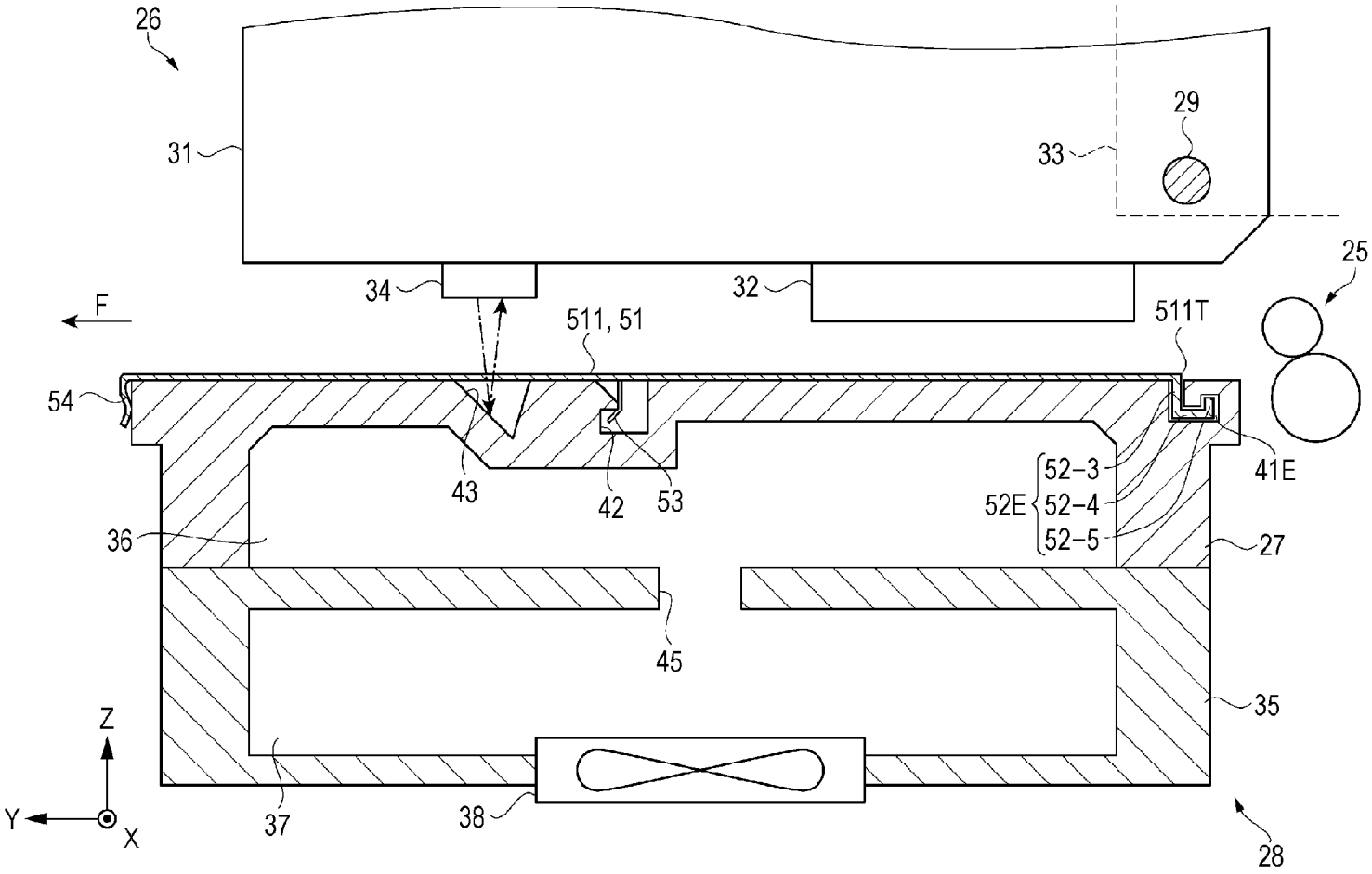
FIG. 14 is a schematic cross-sectional view of an area in which a medium holding member according to a modification example of embodiment 3 of the invention is attached.

FIG. 14 is a diagram corresponding to FIG. 12 and is a schematic cross-sectional view of an area in which a medium holding member according to a modification example of embodiment 3 is attached.

In this modification example, both of the shape of a first fixing member 52E that is formed in each of a pair of medium holding members 51 and the shape of a first groove portion 41E that is formed in a medium supporting portion 27 are different from the case of embodiment 3. Configurations other than these different points in this modification example are the same as those of embodiment 3.

As shown in FIG. 14, the first fixing member 52E includes a portion 52-3 extending in a direction perpendicular to the transportation direction F (i.e., extending in the Z(−) direction), a portion 52-4 extending in the transportation direction F (i.e., extending in a direction perpendicular to the Z direction), and a portion 52-5 extending in a direction perpendicular to the transportation direction F (i.e., extending in the Z(+) direction). That is, a member resulting from adding the portion 52-5 extending in the direction perpendicular to the transportation direction F (i.e., extending in the Z(+) direction) to the first fixing member 52C of embodiment 3 is the first fixing member 52E according to this modification example.

The first groove portion 41E has a shape into which the first fixing member 52E can be fit.

That is, each of the first fixing member 52E and the first groove portion 41E, according to this modification example, has a J-shaped cross section. Each of the first fixing member 52C and the first groove portion 41C, according to embodiment 3, has an L-shaped cross section. In this respect, this modification example is different from embodiment 3.

As compared with the case where each of the first fixing member 52C and the first groove portion 41C has the L-shaped cross section, it is possible to more strongly suppress an upstream side edge portion of each of the pair of medium holding members 51 from lifting in the Z direction by configuring such that each of the first fixing member 52E and the first groove portion E forms the J-shaped cross section.

Embodiment 4

Figure 15:
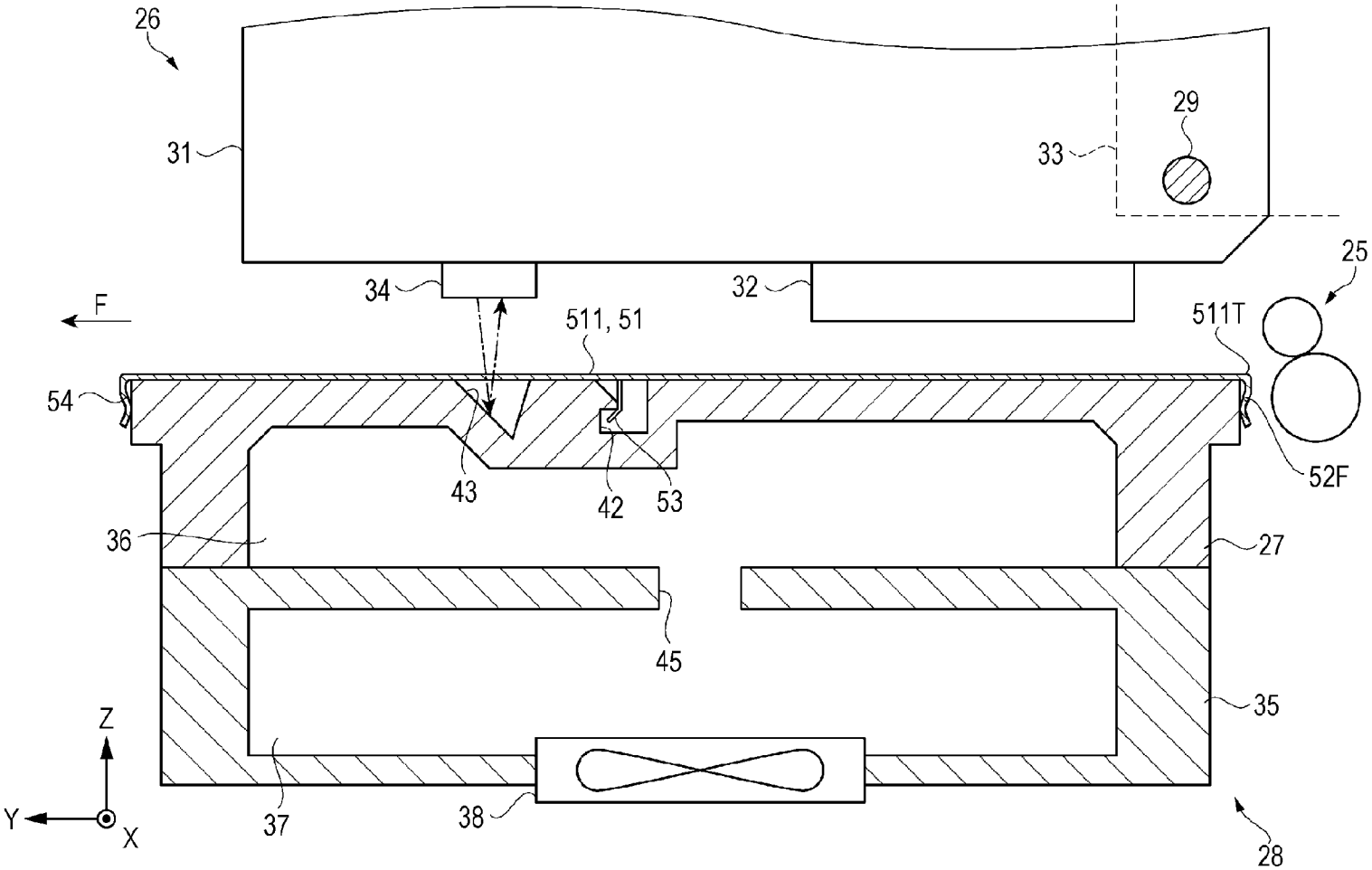
FIG. 15 is a schematic cross-sectional view of an area in which a medium holding member according to embodiment 4 of the invention is attached.
Figure 16:
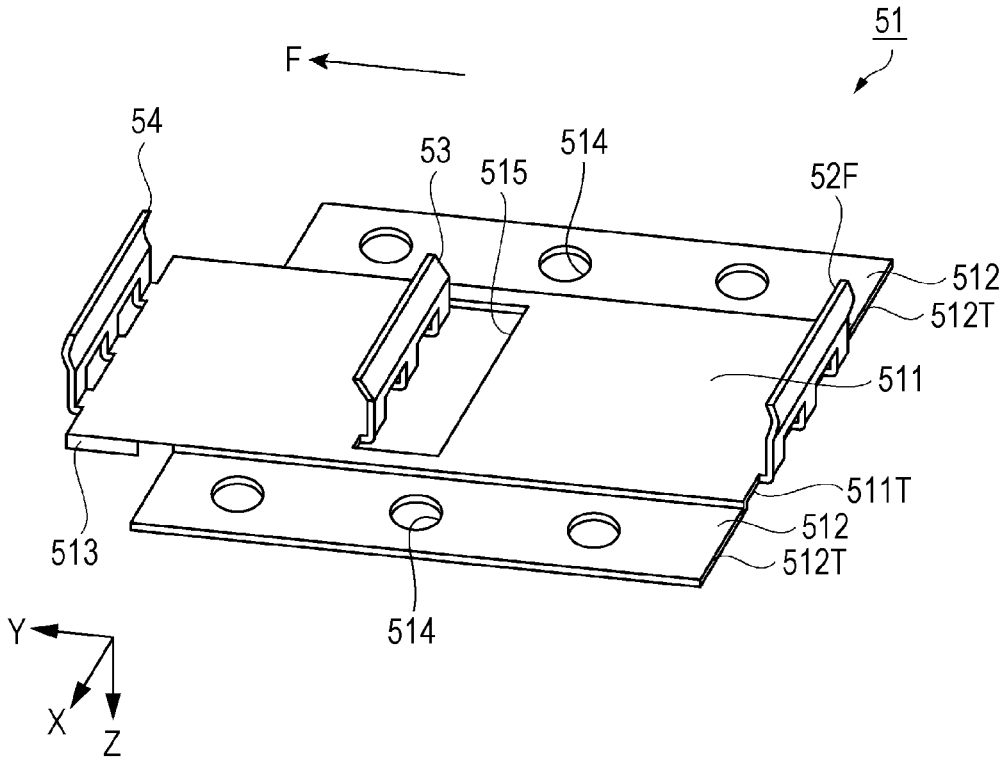
FIG. 16 is a perspective view of a medium holding member according to embodiment 4 of the invention.

FIG. 15 is a diagram corresponding to FIG. 4 and is a schematic cross-sectional view of an area in which a medium holding member according to embodiment 4 is attached. FIG. 16 is a diagram corresponding to FIG. 6 and is a perspective view of a medium holding member according to this embodiment.

In this embodiment, the shape of a first fixing member 52F that is formed in each of a pair of medium holding members 51 is different from the case of embodiment 1. Moreover, the first groove portion 41 of embodiment 1 is not formed in a medium supporting portion 27 of this embodiment. These are different points between this embodiment and embodiment 1. Configurations other than these different points in this embodiment are the same as those of embodiment 1.

Hereinafter, while referring to FIGS. 15 and 16, a recording apparatus according to this embodiment will be described focusing around the different points between the recording apparatus according to this embodiment and the recording apparatus 1 according to embodiment 1. Further, in this embodiment, constituent members identical to the constituent members of embodiment 1 are denoted by reference signs identical to those of the constituent members of embodiment 1, and thereby duplicated descriptions are omitted.

As shown in FIGS. 15 and 16, the first fixing member 52F is formed by folding an upstream side edge portion of a first portion 511 of each of the pair of medium holding members 51 in the transportation direction F, toward the Z(−) direction side. The first fixing member 52F is attached so as to firmly grasp an upstream side edge portion of the medium supporting portion 27 in the transportation direction F. The first fixing member 52F is a kind of spring member (engaging member) that is elastically deformed. A spring energizing force caused by deforming the first fixing material 52F causes the upstream side edge portion of the first portion 511 of each of the pair of medium holding members 51 in the transportation direction F to be engaged with (fixed to) the medium supporting portion 27.

Further, the first fixing member 52F is attached so as to firmly grasp the upstream side edge portion of the medium supporting portion 27 in the transportation direction F, and the upstream side edge portion of the first portion 511 of each of the pair of medium holding members 51 in the transportation direction F protrudes over the medium supporting portion 27 in a plan view.

In this embodiment, a spring energizing force caused by deforming the first fixing member 52F makes it possible to firmly fix the upstream side edge portion of the first portion 511 of each of the pair of medium holding members 51 in the transportation direction F to the medium supporting portion 27. Accordingly, as compared with the case of embodiment 1, the upstream side edge portion of the first portion 511 of each of the pair of medium holding members 51 in the transportation direction F becomes harder to lift in the Z(+) direction, and thus, it becomes possible to more strongly suppress the occurrence of a defect (a failure of the liquid ejecting portion 32) due to the interference between at least one of the medium holding members 51 and the liquid ejecting portion 32.

The entire disclosure of Japanese Patent Application No. 2014-200017, filed Sep. 30, 2014 is expressly incorporated by reference herein.

What is claimed is:

1. A medium holding member configured to interface with a medium supporting portion, the medium holding member comprising:

a fitting portion that is configured to slidably engage the medium supporting portion and that is located, with reference to a medium transport direction, at an upstream side edge portion of the medium holding member, and the fitting portion further configured to releasably engage a first groove portion defined by the medium supporting portion, and the first groove portion inclining, relative to the medium transport direction, from an upstream side to a downstream side.

2. The medium holding member according to claim 1, wherein the fitting portion includes a portion that inclines, with reference to the medium transport direction, from upstream to downstream.

3. The medium holding member according to claim 1, wherein the fitting portion includes a portion extending in the medium transportation direction.

4. The medium holding member according to claim 1, further comprising an engaging portion that configured to slidably engage the medium supporting portion and that is located at a downstream edge portion of the medium holding member.

5. The medium holding member according to claim 1, further comprising a latching portion that is latched together with the medium supporting portion and that is located further downstream than the fitting portion in the medium transportation direction.

6. The medium holding member according to claim 5, wherein the fitting portion includes an aperture located near the latching portion.

7. The medium holding member according to claim 1 is configured such that: the medium holding member is fixed to the medium supporting portion at each of at least three portions whose positions are different from one another.

8. The medium holding member according to claim 1 further comprising a medium receiving portion that receives the medium and is disposed between the medium holding member and the medium supporting portion, and that is located at each of at least one portion in the upstream side edge portion of the medium holding member in the medium transportation direction.

9. The medium holding member according to claim 1, wherein the fitting portion includes an opening through which an edge of a medium is visible when the medium is positioned between the fitting portion and the medium supporting portion.

10. The medium holding member according to claim 1, wherein when the fitting portion is releasably engaged with the medium supporting portion, the fitting portion is slidable along the medium supporting portion in a direction generally transverse to a medium transportation direction.

11. A recording apparatus comprising:

a transportation portion that transports a medium in a transportation direction;

a recording portion that performs recording onto the medium; and a medium supporting portion that supports the medium, wherein the medium supporting portion includes a groove portion configured to slidably receive a fitting portion of a medium holding member that holds the medium, and the groove portion inclining, relative to the transportation direction, from an upstream side to a downstream side.

12. The recording apparatus according to claim 11, wherein the medium supporting portion includes a concave portion that is latched together with a latching portion of the medium holding member and that is located at a more downstream side position than a position of the fitted portion in the transportation direction.

13. The recording apparatus according to claim 11, wherein the fitting portion includes an opening through which an edge of a medium is visible when the medium is positioned between the fitting portion and the medium supporting portion.

14. The recording apparatus according to claim 11, wherein when the fitting portion is releasably engaged with the groove portion of the medium supporting portion, the fitting portion is slidable along the groove portion in a direction generally transverse to a medium transportation direction.

* * * * *